US011137709B2

(12) United States Patent
Kohno et al.

(10) Patent No.: US 11,137,709 B2
(45) Date of Patent: Oct. 5, 2021

(54) IMAGE FORMING APPARATUS WITH CONTROLLER FOR CONTROLLING VOLTAGE AT TRANSFER NIP

(71) Applicant: CANON KABUSHIKI KAISHA, Tokyo (JP)

(72) Inventors: Tatsuya Kohno, Abiko (JP); Takenori Sueoka, Tsukuba (JP); Yusuke Minato, Kashiwa (JP); Mitsuru Yamatani, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/912,909

(22) Filed: Jun. 26, 2020

(65) Prior Publication Data

US 2020/0409299 A1 Dec. 31, 2020

(30) Foreign Application Priority Data

Jun. 29, 2019 (JP) ..... JP2019-122577

(51) Int. Cl.
*G03G 15/00* (2006.01)
*G03G 15/16* (2006.01)

(52) U.S. Cl.
CPC ..... *G03G 15/5054* (2013.01); *G03G 15/1675* (2013.01)

(58) Field of Classification Search
CPC ..... G03G 15/5054
See application file for complete search history.

(56) References Cited

U.S. PATENT DOCUMENTS

2008/0181636 A1 7/2008 Izumi
2013/0058671 A1* 3/2013 Miyoshi ..... G03G 15/0173 399/66
2017/0176895 A1 6/2017 Kuroda et al.

FOREIGN PATENT DOCUMENTS

JP 2004-117920 A 4/2004
JP 2008-102552 A 5/2008
JP 2008-102558 A 5/2008
JP 2008-186013 A 8/2008
JP 2008-275946 A 11/2008
JP 2017-116591 A 6/2017

OTHER PUBLICATIONS

Co-pending U.S. Appl. No. 16/908,854, filed Jun. 23, 2020.

* cited by examiner

*Primary Examiner* — Victor Verbitsky
(74) *Attorney, Agent, or Firm* — Venable LLP

(57) ABSTRACT

An image forming apparatus includes an image bearing member, a transfer member, a voltage source, a current detecting portion, and a controller. In a case that the predetermined voltage is changed in a first job on the basis of the detection result of the current detecting portion during passing of the recording material through the transfer portion, in a second job subsequent to the first job, when a first recording material of the second job passes through the transfer portion, the controller changes a voltage applied to the transfer member on the basis of the predetermined voltage changed in the first job.

7 Claims, 19 Drawing Sheets

| | | AMBIENT WATER CONTENT (g/Kg) | | | | |
|---|---|---|---|---|---|---|
| | | ≤0.9 | ··· | 8.9 | ··· | 21.5≤ |
| | · | · | | · | | · |
| | · | · | | · | | · |
| BASIS WEIGHT ($g/m^2$) | 80～100 | 1000V | ··· | 500V | ··· | 200V |
| | 101～125 | 1150V | ··· | 600V | ··· | 250V |
| | 126～150 | 1300V | ··· | 700V | ··· | 300V |
| | · | · | | · | | · |
| | · | · | | · | | · |

Fig. 5

| A4 SIZE | AMBIENT WATER CONTENT (g/Kg) | | | | | | |
|---|---|---|---|---|---|---|---|
| | ≤0.9 | 1.73 | 5.8 | 8.9 | 15 | 18.5 | 21.5≤ |
| UPPER LIMIT CURRENT | 70 | ··· | ··· | 50 | ··· | ··· | 35 |
| LOWER LIMIT CURRENT | 50 | ··· | ··· | 30 | ··· | ··· | 15 |

Fig. 6

IMAGE FORMING APPARATUS WITH CONTROLLER FOR CONTROLLING VOLTAGE AT TRANSFER NIP

FIELD OF THE INVENTION AND RELATED ART

The present invention relates to an image forming apparatus, such as a copying machine, a printer or a facsimile machine, using an electrophotographic type or an electrostatic recording type.

Conventionally, in the image forming apparatus using the electrophotographic type or the like, a toner image is electrostatically transferred from a photosensitive member or an intermediary transfer belt as an image bearing member onto a recording material such as paper. This transfer is carried out in many cases by applying a transfer voltage to a transfer member such as a transfer roller for forming a transfer portion in contact with the image bearing member. When the transfer voltage is excessively low, a "poor image density (transfer void)" such that the transfer is not sufficiently carried out and a desired image density cannot be obtained occurs in some instances. Further, when the transfer voltage is excessively high, electric discharge occurs at a transfer portion and a polarity of electric charges of toner of the toner image is reversed by the influence of the electric discharge, so that a "white void" such that the toner image is not partly transferred occurs in some instances. For that reason, in order to form a high-quality image, it is required that a proper transfer voltage is applied to the transfer member.

An electric charge amount necessary for the transfer variously fluctuates depending on a size of a recording material and an areal ratio of the toner image. For that reason, the transfer voltage is acquired in many cases by constant-voltage control in which a certain voltage corresponding to a predetermined current density is applied. This is because in the case where the transfer voltage is applied by the constant-voltage control, a transfer current depending on a predetermined voltage is easily ensured at an objective toner existing portion irrespective of a current flowing outside the recording material or through a toner image absence portion on the recording material. However, an electric resistance of the transfer member constituting the transfer portion varies depending on a variation of a product, a kind of the recording material, a cumulative use (operation) time and the like, so that the electric resistance of the recording material passing through the transfer portion also changes depending on the kind of the recording material, ambient environment (temperature, humidity) and the like. For that reason, in the case where the transfer voltage is subjected to constant-voltage control, there is a need to adjust the transfer voltage correspondingly to fluctuations in electric resistance of the transfer member and the recording material.

In Japanese Laid-Open Patent Application (JP-A) 2004-117920, the following control method of a transfer voltage in a constitution in which the transfer voltage is subjected to constant-voltage control has been disclosed. A predetermined voltage is applied to the transfer portion where the recording material is absent immediately before a start of continuous image formation and a current value is detected, so that a voltage value at which a predetermined target current is obtained is acquired. Then, a recording material part (sharing) voltage depending on the kind of the recording material is added to this voltage value, and a transfer voltage value applied in the constant voltage control during the transfer is set. By such control, it is possible to apply the transfer voltage depending on a desired (predetermined) target current through the constant-voltage control irrespective of a fluctuation in electric resistance value of the transfer portion such as the transfer member and a fluctuation in electric resistance value of the recording material.

Here, the kind of the recording material includes a kind depending on a difference in surface smoothness of the recording material such as high-quality paper or coated paper and a kind depending on a difference in thickness of the recording material such as thin paper or thick paper, for example. The recording material part voltage can be acquired in advance depending on such a kind of the recording material, for example. However, the kind of recording materials put in circulation is very large. Further, although the electric resistance of the recording material is also different depending on a moist state (water content of the recording material), the water content of the recording material fluctuates depending on a time or the like in which the recording material is placed in an environment even when the environment (temperature, humidity) is the same. For that reason, it is difficult to acquire the recording material part voltage in advance with accuracy in many instances. When the transfer voltage inclusive of an amount corresponding to the fluctuation in electric resistance of the recording material is not a proper value, as described above, an image defect such as the poor image density (transfer void) or the white void occurs in some instances.

In order to solve such a problem, in JP-A 2008-102558 and JP-A 2008-275946, in the constitution in which the transfer voltage is subjected to the constant-voltage control, it has been proposed that an upper limit and a lower limit of a current (transfer current) supplied to the transfer portion when the recording material passes through the recording material. Incidentally, passing of the recording material through the transfer portion is also referred to as "sheet (paper) passing". The transfer current supplied to the transfer portion during the sheet passing can be caused to fall within a predetermined range, and therefore, it is possible to suppress generation of the image defect due to excess and deficiency of the transfer current. In JP-A 2008-102558, the upper limit is acquired on the basis of environmental information. In JP-A 2008-275946, the upper limit and the lower limit are acquired depending on front/back of the recording material, the kind of the recording material and the size of the recording material in addition to the environmental information.

Incidentally, in the constitution in which the transfer voltage is subjected to the constant-voltage control, control in which a target voltage for the constant-voltage control of the transfer voltage is changed so that the current falls within a predetermined range in the case where the current flowing through the transfer member when the recording material passes through the transfer portion is also referred to as "limiter control". Further, here, a magnitude (high/low) of the voltage and the current is compared on an absolute value basis.

As described above, the limiter control such that the transfer current during the sheet passing is detected and the transfer voltage is controlled so that the transfer current falls within a predetermined range (not more than the upper limit and not less than the lower limit) is carried out. In the limiter control, after detection that the transfer current is out of the predetermined range is made, a change of the transfer voltage is carried out so that the transfer current falls within the predetermined range. For that reason, in a region of the recording material passing through the transfer portion in a period from the detection of the transfer control until the change of the transfer voltage is completed, the transfer current is out of a proper range, and therefore, an image defect such as a lowering in (image) density due to excess and deficiency of the transfer current occurs in some instances.

For example, in a region in which the transfer current is below the lower limit in a low humidity environment, the poor image density (transfer void) due to the deficiency of the transfer current occurs. Further, in the case where the poor image density 8 transfer void) occurs in such a manner in the last job, also in a subsequent job, there is a high possibility that a similar poor image density (transfer void) occurs. This is because it would be considered that there is a high possibility that the recording material used in the subsequent job is the same in kind as the recording material used in the last job and thus that a left-standing state of the recording material in the subsequent job is also similar to the left-standing state of the recording material in the last job. Incidentally, the job refers to a series of operations which is started by a single start instruction and in which an image or images are formed and outputted on a single recording material or a plurality of recording materials.

SUMMARY OF THE INVENTION

A principal object of the present invention is to provide an image forming apparatus capable of suppressing that an image defect similar to an image defect generated due to excess and deficiency of a transfer current in the last job generates again in a job subsequent to the last job.

According to an aspect of the present invention, there is provided an image forming apparatus comprising: an image bearing member configured to bear a toner image; a transfer member forming a transfer portion configured to transfer the toner image from the image bearing member onto a recording material; a voltage source configured to apply a voltage to the transfer member; a current detecting portion configured to detect a current flowing through the transfer member; and a controller configured to effect constant-voltage control so that the voltage applied to the transfer member is a predetermined voltage when the recording material passes through the transfer portion, wherein on the basis of a detection result of the current detecting portion, the controller is capable of changing the predetermined voltage applied to the transfer member so that the detection result of the current detecting portion falls within a predetermined range, and wherein in a case that the predetermined voltage is changed in a first job on the basis of the detection result of the current detecting portion during passing of the recording material through the transfer portion, in a second job subsequent to the first job, when a first recording material of the second job passes through the transfer portion, the controller changes a voltage applied to the transfer member on the basis of the predetermined voltage changed in the first job.

Further features of the present invention will become apparent from the following description of exemplary embodiments with reference to the attached drawings.

BRIEF DESCRIPTION OF THE DRAWINGS

FIG. 5 is a table showing an example of table data of a recording material part (sharing) voltage.

FIG. 6 is a table showing an example of table data of a predetermined current range.

Figure 13:
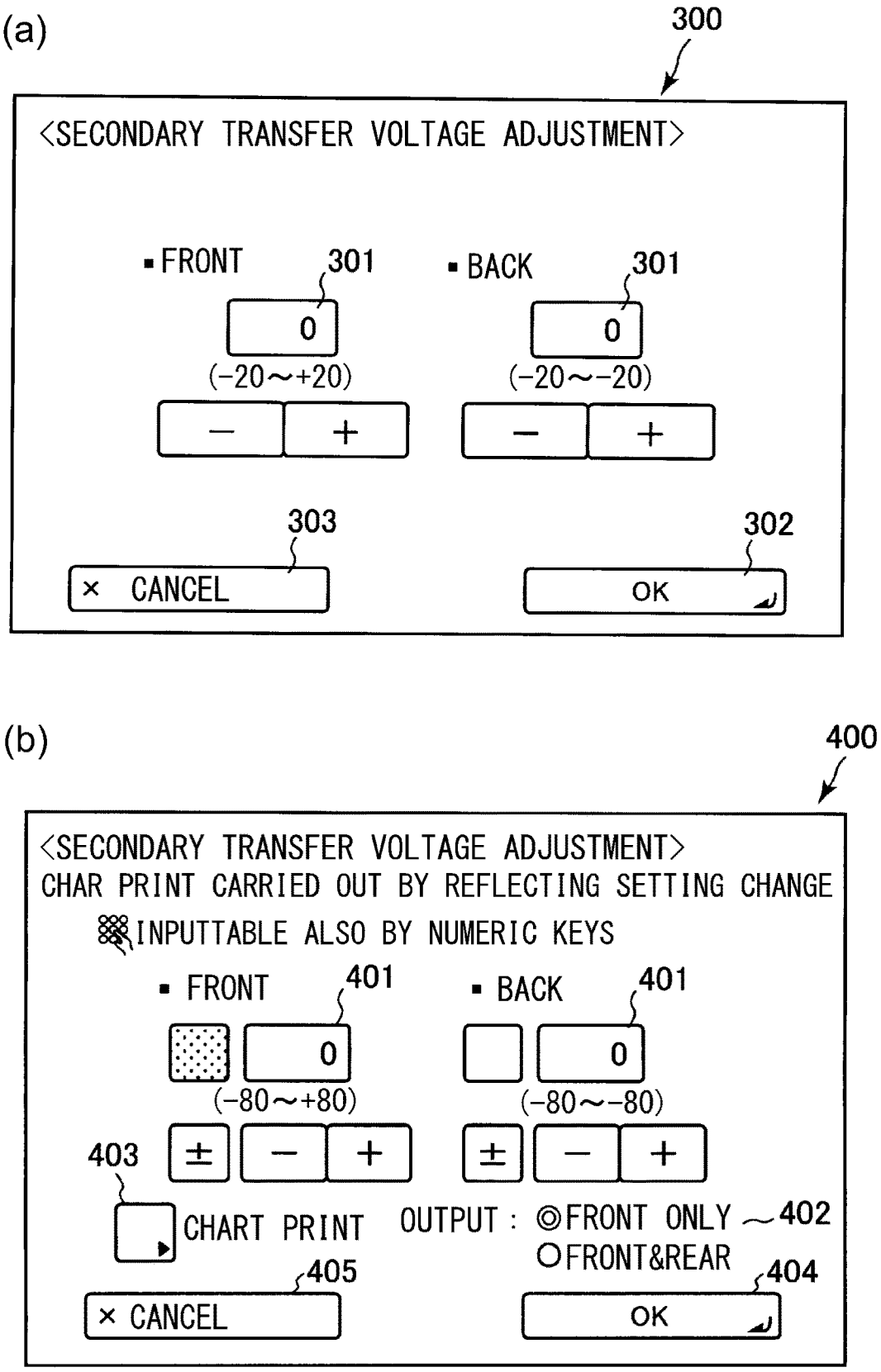

Parts (a) and (b) of FIG. 13 are schematic views each showing an adjusting screen of an operation in an adjusting mode of a secondary transfer voltage.

Figure 14:
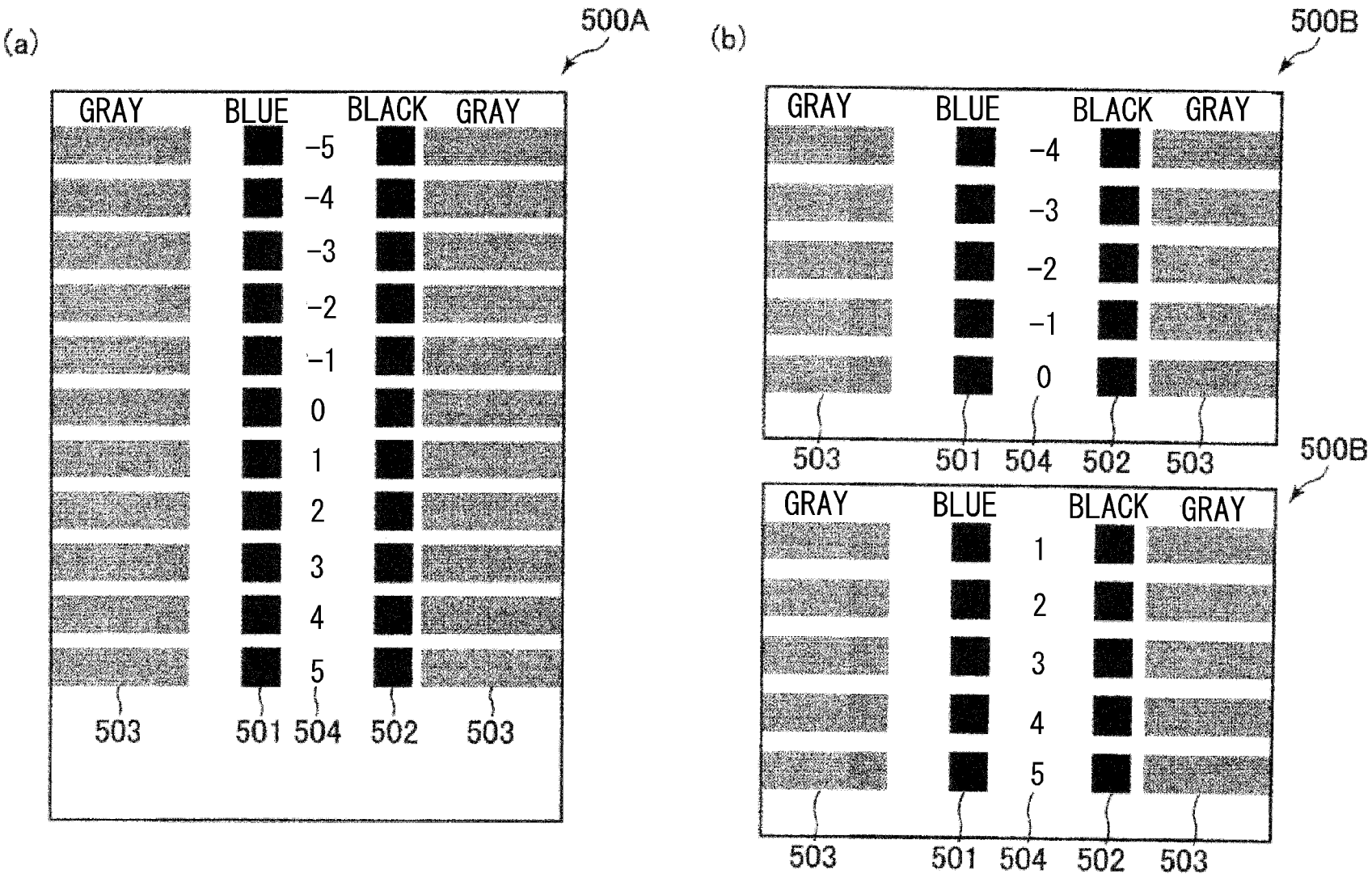

Parts (a) and (b) of FIG. 14 are schematic views each showing an example of a chart outputted by the operation in the adjusting mode of the secondary transfer voltage.

Figure 15:
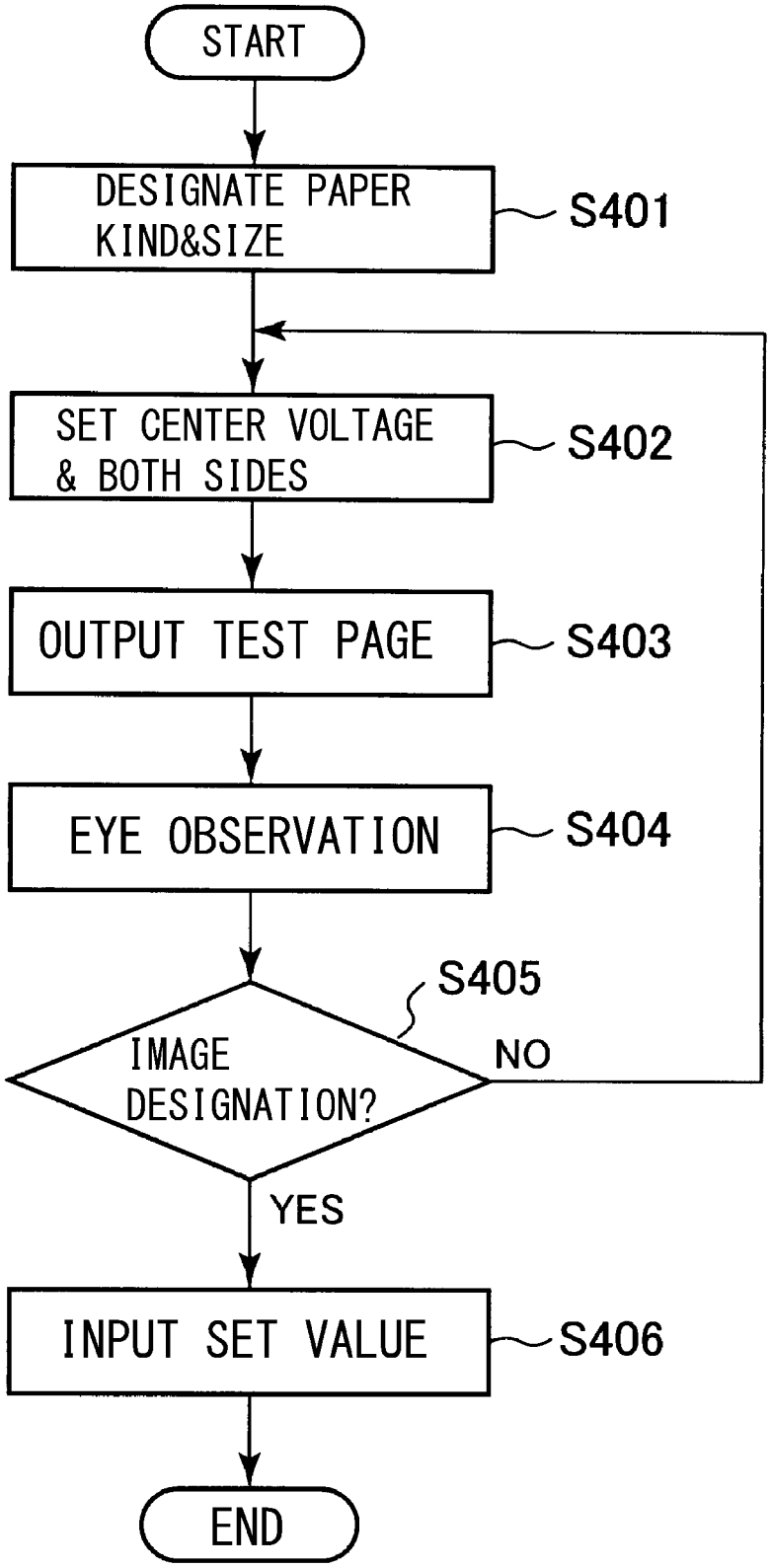

FIG. 15 is a flowchart of an example of the operation in the adjusting mode of the secondary transfer voltage.

Figure 16:
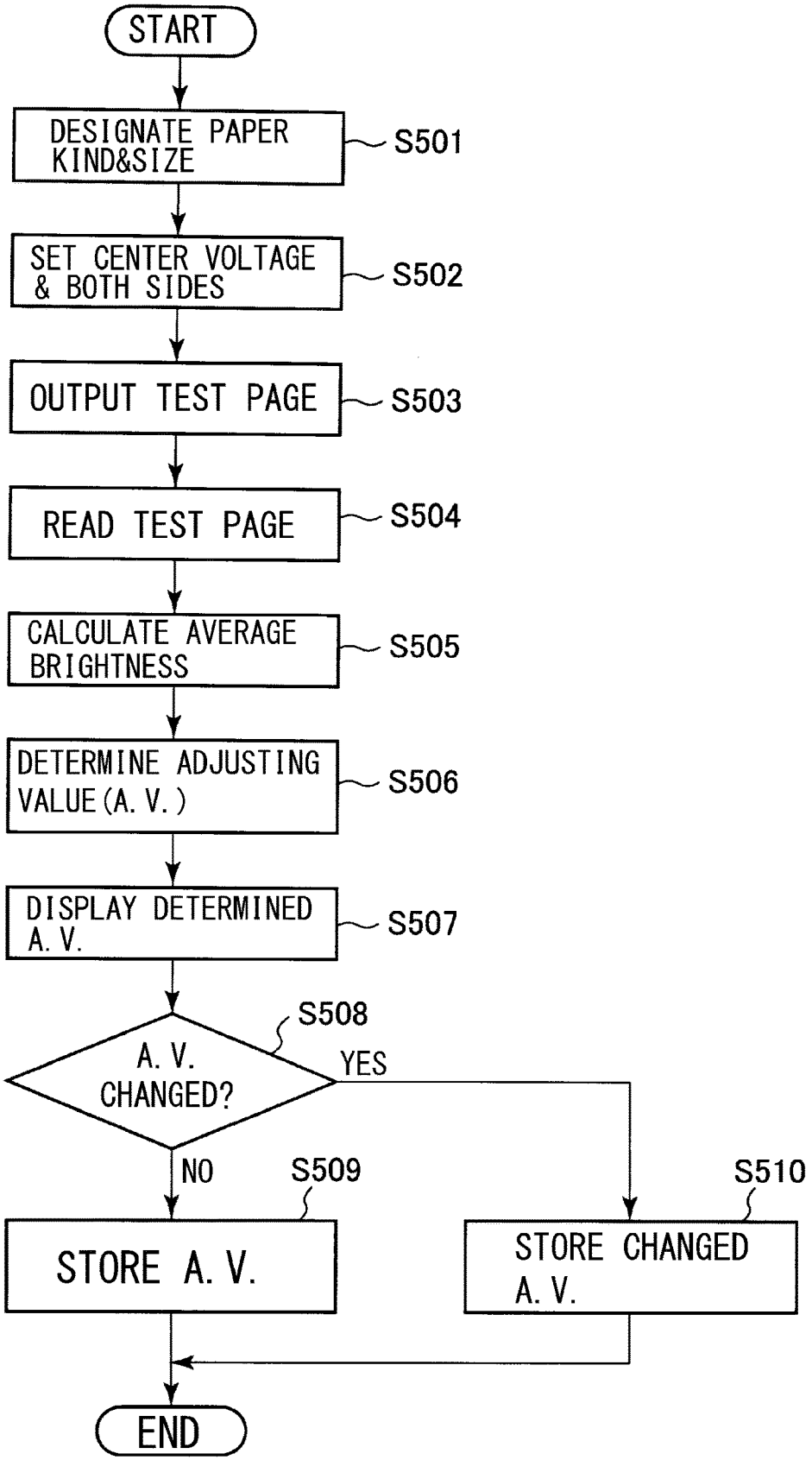

FIG. 16 is a flowchart of another example of the operation in the adjusting mode of the secondary transfer voltage.

Figure 17:
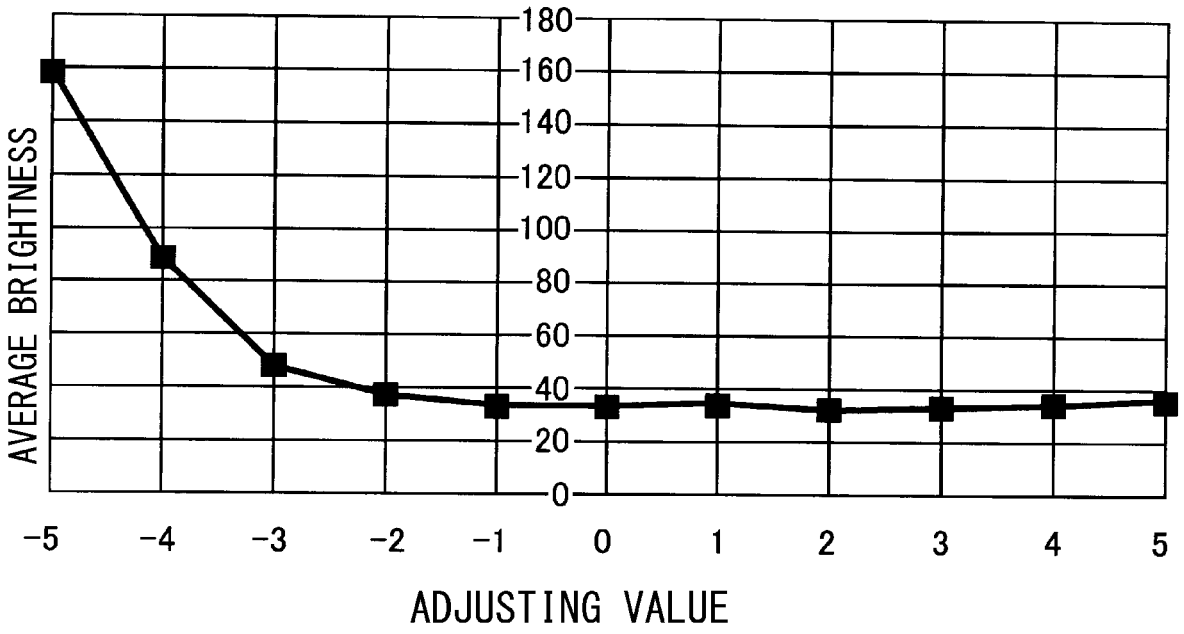

FIG. 17 is a graph showing an example of an acquisition result of brightness information of a chart in the operation in the adjusting mode of the secondary transfer voltage.

Figure 18:
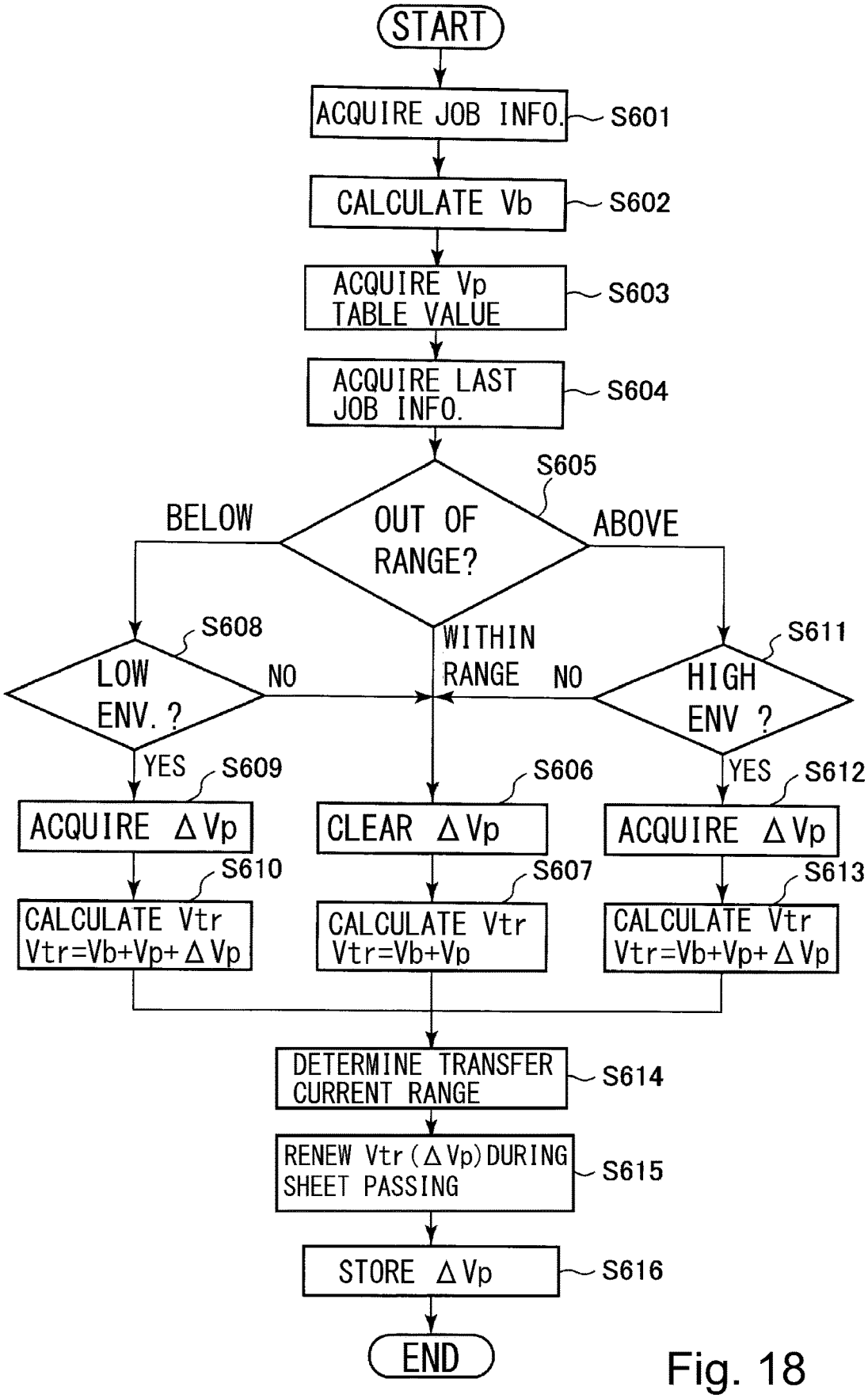

FIG. 18 is a flowchart of secondary transfer voltage control in an embodiment 5.

Figure 19:
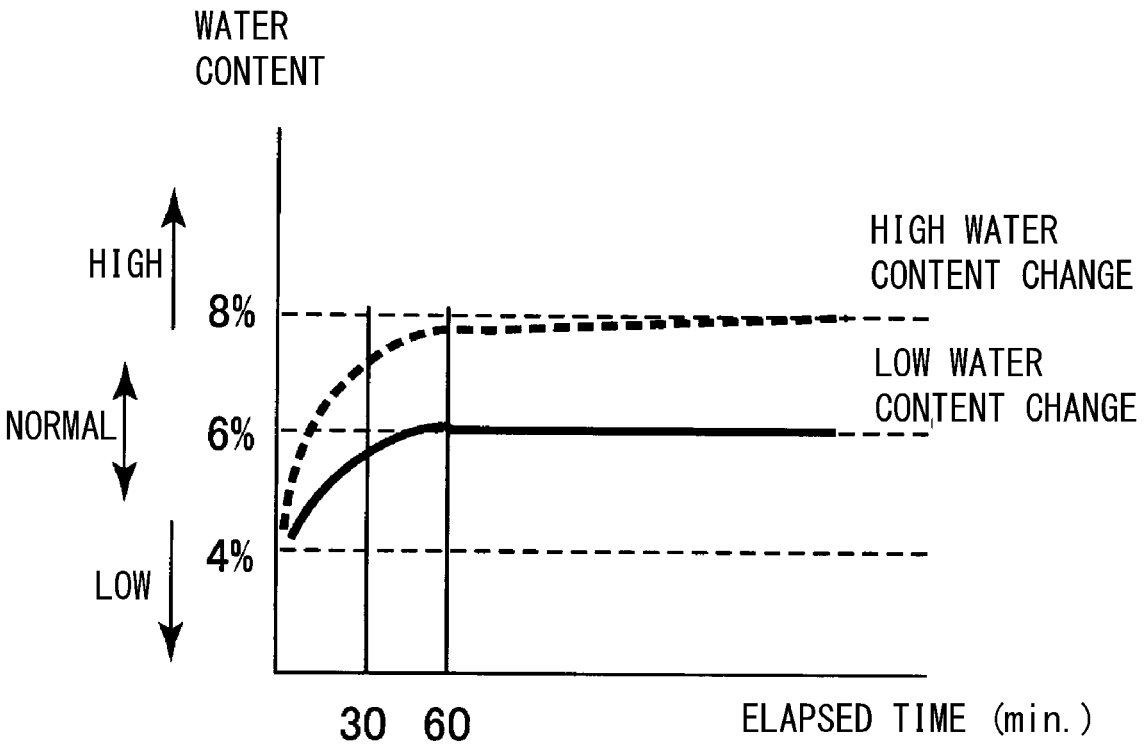

FIG. 19 is a graph for illustrating progression of a water content of a recording material.

DESCRIPTION OF EMBODIMENTS

An image forming apparatus according to the present invention will be specifically described with reference to the drawings.

Embodiment 1

1. General Constitution and Operation of Image Forming Apparatus

Figure 1:
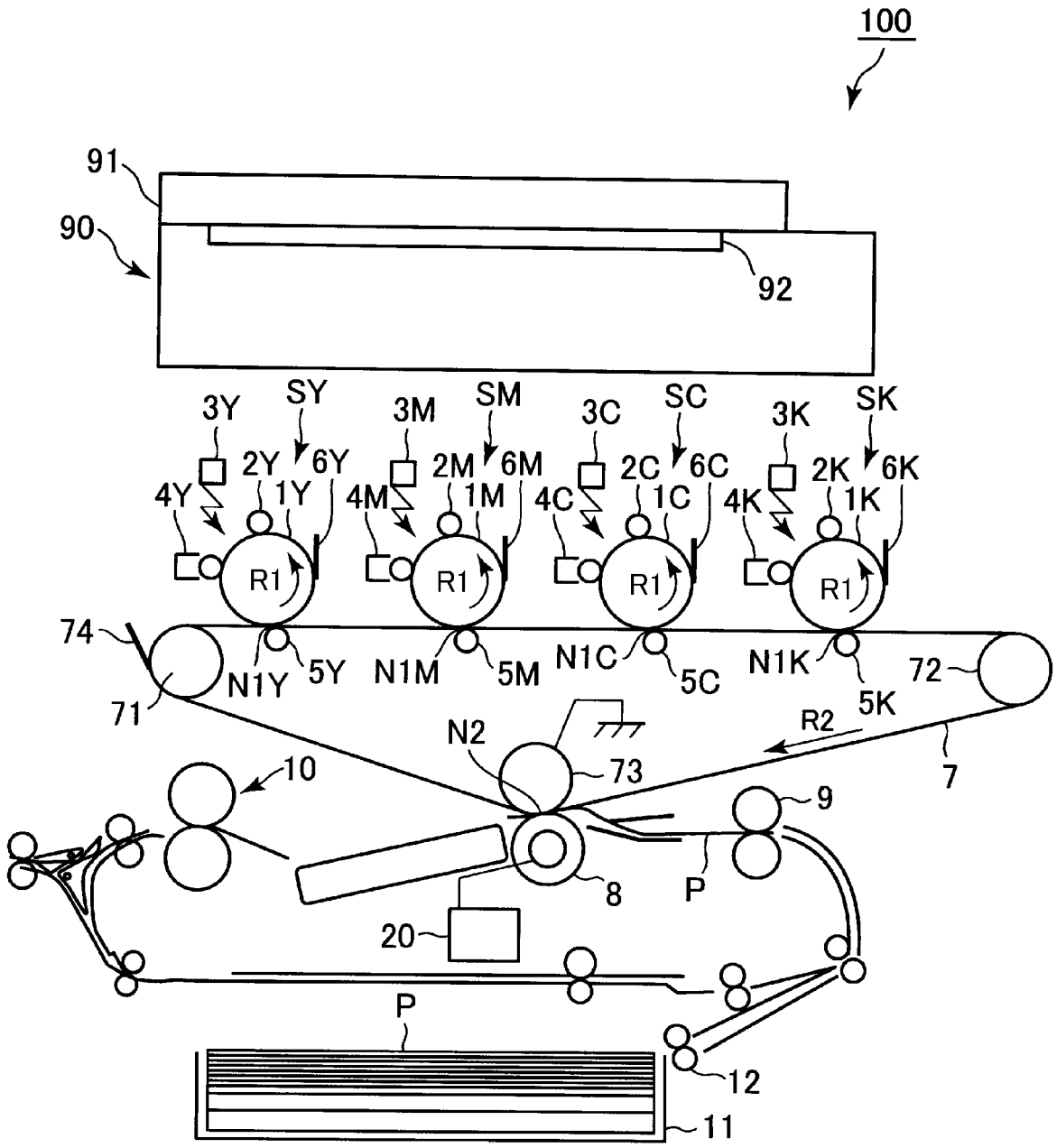
FIG. 1 is a schematic sectional view of an image forming apparatus.

FIG. 1 is a schematic sectional view of an image forming apparatus 100 of the present invention.

The image forming apparatus 100 in this embodiment is a tandem multi-function machine (having functions of a copying machine, a printer and a facsimile machines) which is capable of forming a full-color image using an electrophotographic type and which employs an intermediary transfer type.

The image forming apparatus 100 includes, as a plurality of image forming portions (stations), first to fourth image forming portions SY, SM, SC and SK for forming images of yellow (Y), magenta (M), cyan (C) and black (K). As regards elements of the respective image forming portions SY, SM, SC and SK having the same or corresponding functions or constitutions, suffixes Y, M, C and K for representing the elements for associated colors are omitted, and the elements will be collectively described in some instances. The image forming portion S is constituted by including a photosensitive drum 1, a charging roller 2, an exposure device 3, a developing device 4, a primary transfer roller 5, a drum cleaning device 6 which are described later.

The photosensitive drum 1 which is a rotatable drum-shaped (cylindrical) photosensitive member (electrophotographic photosensitive member) as a first image bearing member for bearing a toner image is rotationally driven in an arrow R1 direction (counterclockwise direction) in FIG. 1. A surface of the rotating photosensitive drum 1 is electrically charged uniformly to a predetermined polarity (negative in this embodiment) and a predetermined potential by the charging roller 2 which is a roller-type charging member as a charging means. The charged photosensitive drum 1 is subjected to scanning exposure to light by the exposure device (laser scanner device) 3 as an exposure means on the basis of image information, so that an electrostatic image (electrostatic latent image) is formed on the photosensitive drum 1.

The electrostatic image formed on the photosensitive drum 1 is developed (visualized) by supplying toner as a developer by the developing device 4 as a developing means, so that a toner image is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged (reverse development type). In this embodiment, a normal charge polarity of the toner which is the charge polarity of the toner during development is a negative polarity. The electrostatic image formed by the exposure device 3 is an aggregate of small not images, and a density of the toner image to be formed on the photosensitive drum 1 can be changed by changing a density of the dot images. In this embodiment, the toner image of each of the respective colors has a maximum density of about 1.5-1.7, and a toner application amount per unit area at the maximum density is about 0.4-0.6 mg/cm$^2$.

As a second image bearing member for bearing the toner image, an intermediary transfer belt 7 which is an intermediary transfer member constituted by an endless belt is provided so as to be contactable to the surfaces of the four photosensitive drums 1. The intermediary transfer belt 7 is an example of an intermediary transfer member for feeding the toner image in order that the toner image primary-transferred from another image bearing member is secondary-transferred onto a recording material. The intermediary transfer belt 7 is stretched by a plurality of stretching rollers including a driving roller 71, a tension roller 72, and a secondary transfer opposite roller 73. The driving roller 71 transmits a driving force to the intermediary transfer belt 7. The tension roller 72 controls tension of the intermediary transfer belt 7 at a constant value. The secondary transfer opposite roller 73 functions as an opposing member (opposing electrode) to a secondary transfer roller 8 described later. The intermediary transfer belt 7 is rotated (circulated or moved) at a feeding speed (peripheral speed) of about 300-500 mm/sec in an arrow R2 direction (clockwise direction) in FIG. 1 by rotational drive of the driving roller 71.

To the tension roller 72, a force such that the intermediary transfer belt 7 is pushed out from an inner peripheral surface side toward an outer peripheral surface side is applied by a force of a spring as an urging means, so that by this force, tension of about 2-5 kg is exerted on the intermediary transfer belt 7 with respect to a feeding direction of the intermediary transfer belt 7. On the inner peripheral surface side of the intermediary transfer belt 7, the primary transfer rollers 5 which are roller-type primary transfer members as primary transfer means are disposed correspondingly to the respective photosensitive drums 1. The primary transfer roller 5 is urged (pressed) toward an associated photosensitive drum 1 through the intermediary transfer belt 7, whereby a primary transfer portion (primary transfer nip) N1 where the photosensitive drum 1 and the intermediary transfer belt 7 contact each other is formed.

The toner image formed on the photosensitive drum 1 electrostatic transferred primary-transferred by the action of the primary transfer roller 5 onto the rotating intermediary transfer belt 7 at the primary transfer portion T1. During the primary transfer step, to the primary transfer roller 5, a primary transfer voltage (primary transfer bias) which is a DC voltage of an opposite polarity to a normal charge polarity of the toner is applied from an unshown primary transfer voltage source. For example, during full-color image formation, the color toner images of Y, M, C and K formed on the respective photosensitive drums 1 are successively (primary)-transferred superposedly onto the intermediary transfer belt 7.

On an outer peripheral surface side of the intermediary transfer belt 7, at a position opposing the secondary transfer opposite roller 73, the secondary transfer roller 8 which is a roller-type secondary transfer member as a secondary transfer means is provided. The secondary transfer roller 8 is urged toward the secondary transfer roller 73 through the intermediary transfer belt 7 and forms a secondary transfer portion (secondary transfer nip) N where the intermediary transfer belt 7 and the secondary transfer roller 8 contact each other. The toner images formed on the intermediary transfer belt 7 are electrostatically transferred (secondary-transferred) onto a recording material (sheet, transfer(-receiving) material) P such as paper sandwiched and fed by the intermediary transfer belt 7 and the secondary transfer roller 8 at the secondary transfer portion N2 by the action of the secondary transfer roller 8. The recording material P is typically paper (sheet), but is not limited thereto, and in some instances, synthetic paper formed of a resin material, such as waterproof paper, and a plastic sheet such as an OHP sheet, and a cloth and the like are used. During the secondary transfer step, to the secondary transfer roller 8, a secondary transfer voltage (secondary transfer bias) which is a DC voltage of the opposite polarity to the normal charge polarity of the toner is applied from a secondary transfer voltage source (high voltage source circuit) 20. The recording material P is accommodated in a cassette (recording material cassette) 11 or the like as a feeding portion (sheet (paper) feeding portion, accommodating portion), and is fed one by one from the cassette 11 by driving a feeding roller pair 12 on the basis of a feeding start signal, and then is fed to a registration belt pair 9. This recording material P is fed toward the secondary transfer portion N2 by being timed to the toner images on the intermediary transfer belt 7 after being once stopped by the registration roller pair 9.

The recording material P on which the toner images are transferred is fed toward a fixing device 10 as a fixing means by a feeding member or the like. The fixing device 10 heats and presses the recording material P carrying thereon unfixed toner images, and thus fixes (melts) the toner images on the recording material P. Thereafter, the recording material P is discharged (outputted) to an outside of an apparatus main assembly of the image forming apparatus 100.

Further, toner (primary transfer residual toner) remaining on the surface of the photosensitive drum 1 after the primary transfer step is removed and collected from the surface of the photosensitive drum 1 by the drum cleaning device 6 as a photosensitive member cleaning means. Further, deposited matters such as toner (secondary transfer residual toner) remaining on the surface of the intermediary transfer belt 7 after the secondary transfer step, and paper powder are removed and collected from the surface of the intermediary transfer belt 7 by a belt cleaning device 74 as an intermediary transfer member cleaning means.

Here, in this embodiment, the intermediary transfer belt 7 is an endless belt having a three-layer structure of a resin layer, an elastic layer and a surface layer from an inner peripheral surface side to an outer peripheral surface side thereof. A resin material constituting the resin layer, polyimide, polycarbonate or the like can be used. As a thickness of the resin layer, 70-100 μm is suitable. Further, as an elastic material constituting the elastic layer, urethane rubber, chloroprene rubber or the like can be used. As a thickness of the elastic layer, 200-300 μm is suitable. As a material of the surface layer, a material for permitting easy transfer of the toner (image) onto the recording material P at the secondary transfer portion N2 by decreasing a depositing force of the toner onto the surface of the intermediary transfer belt 7 may desirably be used. For example, it is possible to use one or two or more kinds of resin materials such as polyurethane, polyester, epoxy resin and the like. Or, it is possible to use one or two or more kinds of elastic materials such as an elastic material rubber, an elastomer, a butyl rubber and the like. Further, it is possible to use one or two or more kinds of materials of powder or particles such as a material for enhancing a lubricating property by reducing surface energy in a dispersion state in the elastic material, or one or two or more kinds of the power or the particles which are different in particle size and which are dispersed in the elastic material. Incidentally, a thickness of the surface layer may suitably be 5-10 μm. As regards the intermediary transfer belt 7, an electric resistance is adjusted by adding an electroconductive agent for electric resistance adjustment such as carbon black into the intermediary transfer belt 7, so that volume resistivity of the intermediary transfer belt 7 may preferably be $1\times10^{9}$-$1\times10^{14}$ Ω·cm.

Further, in this embodiment, the secondary transfer roller 8 is constituted by including a core metal (base material) and an elastic layer formed with an ion-conductive foam rubber (NBR) around the core metal. In this embodiment, the secondary transfer roller 8 is 24 mm in outer diameter and 6.0-12.0 μm in surface roughness Rz. Further, in this embodiment, the electric resistance of the secondary transfer roller 8 is $1\times10^{5}$-$1\times10^{7}$Ω as measured under application of a voltage of 2 kV in an N/N (23° C./50% RH) environment. Hardness of the elastic layer is about 30-40° in terms of Asker-C hardness. Further, in this embodiment, a dimension (width) of the secondary transfer roller 8 with respect to a longitudinal direction (widthwise direction) (i.e., a length of the secondary transfer roller 8 with respect to a direction substantially perpendicular to the recording material feeding direction) is about 310-340 mm. In this embodiment, the dimension of the secondary transfer roller 8 with respect to the longitudinal direction is longer than a maximum dimension (maximum width) of widths (lengths with respect to the direction substantially perpendicular to the recording material feeding direction) of the recording materials for which feeding is ensured by the image forming apparatus 100. In this embodiment, the recording material P is fed on the basis of a center (line) of the secondary transfer roller 8 with respect to the longitudinal direction, and therefore, all the recording materials P for which feeding is ensured by the image forming apparatus 100 pass through within a length range of the secondary transfer roller 8 with respect to the longitudinal direction. As a result, it is possible to stably feed the recording materials P having various sizes and to stably transfer the toner images onto the recording materials P having the various sizes.

Further, at an upper portion of the apparatus main assembly of the image forming apparatus 100, an automatic original feeding device 91 and an image reading portion (image reading device) 90 as a reading means are provided. The automatic original feeding device 91 automatically feeds the recording material P on which the image is formed, to the image reading portion 90. The image reading portion 90 reads an image on the recording material P fed by the automatic original feeding device 91 or disposed on a platen glass 92. The image reading portion 90 illuminates the recording material P, fed by the automatic original feeding device 91 or disposed on the platen glass 92, with light from a light source (not shown). Then, the image reading portion 90 is constituted so as to read the image formed on the recording material P, by an image reading element (not shown) on a predetermined dot density basis. That is, the image reading portion 90 optically reads the image on the recording material P and converts the read image into an electric signal.

Figure 2:
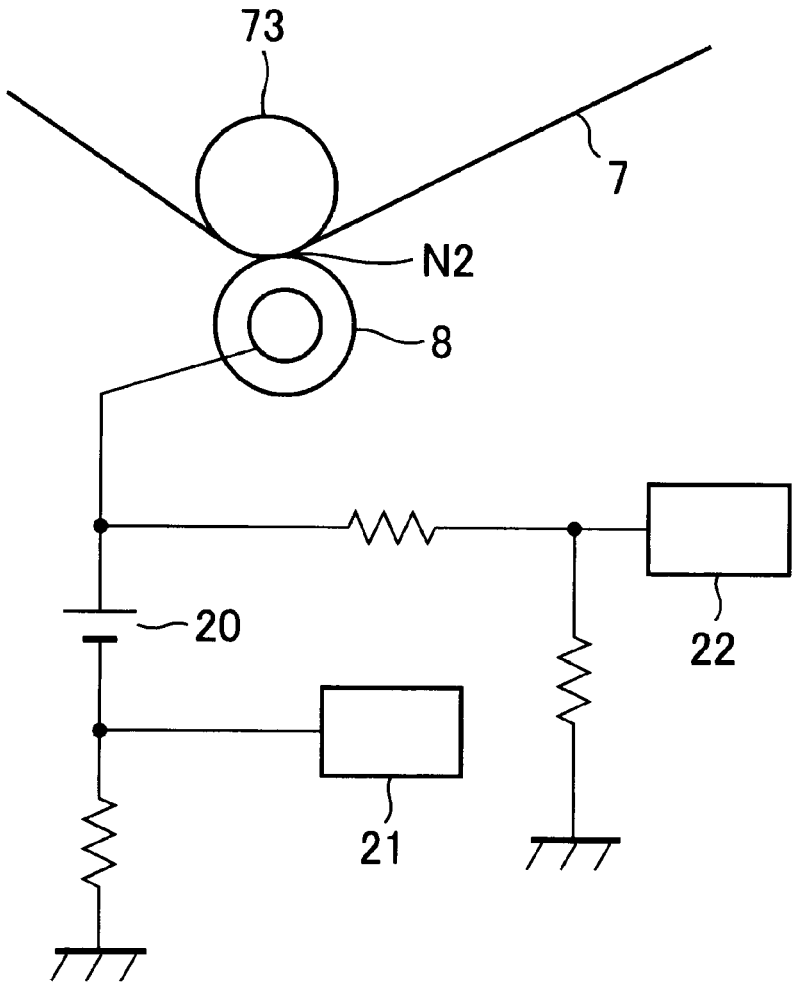
FIG. 2 is a schematic view of a constitution relating to secondary transfer.

FIG. 2 is a schematic view of a constitution regarding the secondary transfer. The secondary transfer roller 8 contacts the intermediary transfer belt 7 toward the secondary transfer opposite roller 73 and thus forms the secondary transfer portion N2. To the secondary transfer roller 8, a secondary transfer voltage source 20 with a variable output current voltage value is connected. The secondary transfer opposite roller 73 is electrically grounded (connected to the ground). When the recording material P passes through the secondary transfer portion N2, to the secondary transfer roller 8, a secondary transfer voltage which is a DC voltage of the opposite polarity to the normal charge polarity of the toner is applied, so that a secondary transfer current is supplied to the secondary transfer portion N2, and thus the toner image is transferred from the intermediary transfer belt 7 onto the recording material P. In this embodiment, during the secondary transfer, for example, the secondary transfer current of +20 to +80 μA is caused to flow through the secondary transfer portion N2. Incidentally, a constitution in which a roller corresponding to the secondary transfer opposite roller 73 in this embodiment is used as the transfer member and the secondary transfer voltage of the same polarity as the normal charge polarity of the toner is applied to the roller and in which a roller corresponding to the secondary transfer 8 is used as an opposite electrode and is electrically grounded may also be employed.

Figure 3:
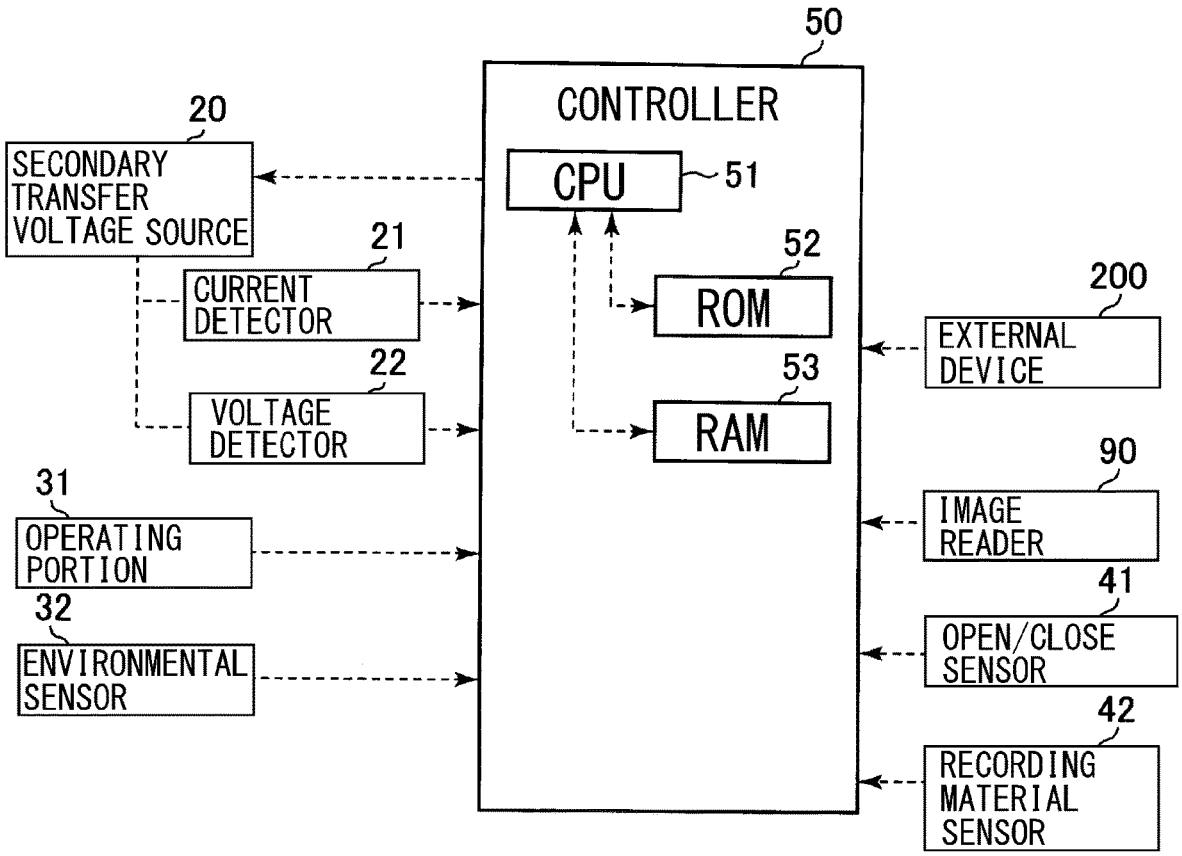
FIG. 3 is a schematic block diagram showing a control mode of a principal part of the image forming apparatus.

In this embodiment, on the basis of information on the electric resistance of the secondary transfer portion N2 (principally the secondary transfer roller 8 in this embodiment) acquired in a state in which the toner image and the recording material P are absent at the secondary transfer portion N2, the secondary transfer voltage to be applied to the secondary transfer roller 8 by the constant-voltage control during the secondary transfer is set. Further, in this embodiment, the secondary transfer current flowing through the secondary transfer portion N2 during the sheet passing is detected. Further, the secondary transfer voltage outputted from the secondary transfer voltage source 20 through the constant-voltage control is controlled so that the secondary transfer current is a predetermined upper limit or less and a predetermined lower limit or more (herein simply referred simply as also a "predetermined current range") (limiter control). This predetermined current range can be set on the basis of various pieces of information. These various pieces of information may also include the following pieces of information, for example. First, the information is information on a condition (a kind of the recording material P or the like) designated by an operating portion 31 (FIG. 10) provided in the main assembly of the image forming apparatus 100 or by an external device 200 (FIG. 3) such as a personal computer communicatably connected to the image forming apparatus 100. Further, the information is information on a detection result of an environmental sensor 32 (FIG. 3). Further, the information is information on the electric resistance of the secondary transfer portion N2 (principally the secondary transfer roller 8 in this embodiment) acquired in a state in which the toner image and the recording material P are absent in the secondary transfer portion N2. For example, the predetermined current range can be changed on the basis of information on the thickness and the width of the recording material P used in the image formation. Incidentally, the information on the thickness and the width of the recording material P can be acquired on the basis of information inputted from the operating portion 31 or the external device 200. Or, it is also possible to carry out control on the basis of information acquired by a detecting means, provided in the image forming apparatus 100, for detecting the thickness and the width of the recording material P.

In this embodiment, in order to carry out such control, to the secondary transfer voltage source 20, a current detecting circuit 21 as a current detecting means (current detecting portion) for detecting a current (secondary transfer current) flowing through the secondary transfer portion N2 (i.e., the secondary transfer voltage roller 8 or the secondary transfer source 20) is connected. Further, to the secondary transfer voltage source 20, a voltage detecting circuit 22 as a voltage detecting means (detecting portion) for detecting a voltage (secondary transfer voltage) outputted from the secondary transfer voltage source 20 is connected. Incidentally, the controller 50 may also function as the voltage detecting portion and may also detect a voltage, outputted by the secondary transfer voltage source 20, from a designated value of the voltage outputted from the secondary transfer voltage source 20. In this embodiment, the secondary transfer voltage source 20, the current detecting circuit 21 and the voltage detecting circuit 22 are provided in the same high-voltage substrate.

2. Control Mode

FIG. 3 is a schematic block diagram showing a control mode of a principal part of the image forming apparatus 100 in this embodiment. A controller (control circuit) 50 as a control means is constituted by including a CPU 51 as a calculation control means which is a dominant element for performing processing, and memories (storing media) such as a RAM 52 and a ROM 53 which are used as storing means. In the RAM 52 which is rewritable memory, information inputted to the controller 50, detected information, a calculation result and the like are stored. In the ROM 53, a data table acquired in advance and the like are stored. The CPU 51 and the memories such as the RAM 52 and the ROM 53 are capable of transferring and reading the data therebetween.

To the controller 50, the image reading portion 90 provided to the image forming apparatus and the external device 200 such as a personal computer are connected. Further, to the controller 50, the operating portion (operating panel) 31 provided in the image forming apparatus 100 is connected. The operating portion 31 is constituted by including a display portion for displaying various pieces of information to an operator such as a user or a service person by control from the controller 50 and including an input portion for inputting various settings on the image formation and the like by the operator. The operating portion 31 may also be constituted by a touch panel or the like having a function of a display portion and a function of an inputting portion. To the controller 50, job information including a control instruction relating to image formation such as the kind of the recording material P is inputted. Incidentally, the kind of the recording material P includes any information capable of discriminating the recording material P, such as attributes based on general features inclusive of plain paper, thin paper, thick paper, glossy paper, coated paper and the like, or a manufacturer, a grade, a product number, a basis weight, a thickness or the like. Incidentally, the controller 50 can acquire information on the kind of the recording material P not only by direct input of the information but also from information set in association with the cassette 11 in advance by selecting the cassette 11 accommodating the recording material P, for example. Further, to the controller 50, the secondary transfer voltage source 20, the current detecting circuit 21 and the voltage detecting circuit 22 are connected. In this embodiment, the secondary transfer voltage source 20 applies, to the secondary transfer roller 8, the secondary transfer voltage which is the DC voltage subjected to the constant-voltage control. Incidentally, the constant-voltage control is control such that a value of a voltage applied to the transfer portion (i.e., the transfer member) is a substantially constant voltage value. Further, to the controller 50, the environmental sensor 32 is connected. The environmental sensor 32 detects an ambient temperature and an ambient humidity in a casing of the image forming apparatus 100. Information on the temperature and the humidity which are detected by the environmental sensor 32 are inputted to the controller 50. On the basis of the temperature and humidity detected by the environmental sensor 32, the controller 50 is capable of acquiring an ambient water content (absolute water content) in the casing of the image forming apparatus 100. The environmental sensor 32 is an example of an environment detecting means for detecting at least one of the temperature and the humidity of at least one of an inside and an outside of the image forming apparatus 100. On the basis of image information from the image reading portion 90 or the external device 200 and a control instruction from the operating portion 31 or the external device 200, the controller 50 carries out integrated control of respective portions of the image forming apparatus 100 and causes the image forming apparatus 100 to execute an image forming operation.

Here, the image forming apparatus 100 executes a job (printing operation) which is a series of operations started by a single start instruction (print instruction) and in which the image is formed and outputted on a single recording material P or a plurality of recording materials P. The job includes an image forming step, a pre-rotation step, a sheet (paper) interval step in the case where the images are formed on the plurality of recording materials P, and a post-rotation step in general. The image forming step is performed in a period in which formation of an electrostatic image for the image actually formed and outputted on the recording material P, formation of the toner image, primary transfer of the toner image and secondary transfer of the toner image are carried out, in general, and during image formation (image forming period) refer to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. In this embodiment, during the non-image formation control of setting an initial value of the secondary transfer voltage and control of determining the upper limit and the lower limit (predetermined current range) of the secondary transfer current during sheet passing are carried out.

Incidentally, the sleep state is a state in which energization to elements of the image forming apparatus 100 other than a part of the elements such as a part of the controller 50 is stopped in the case where a predetermined time set in advance has elapsed from an outputted of a final image.

3. Secondary Transfer Voltage Control

Figure 4:
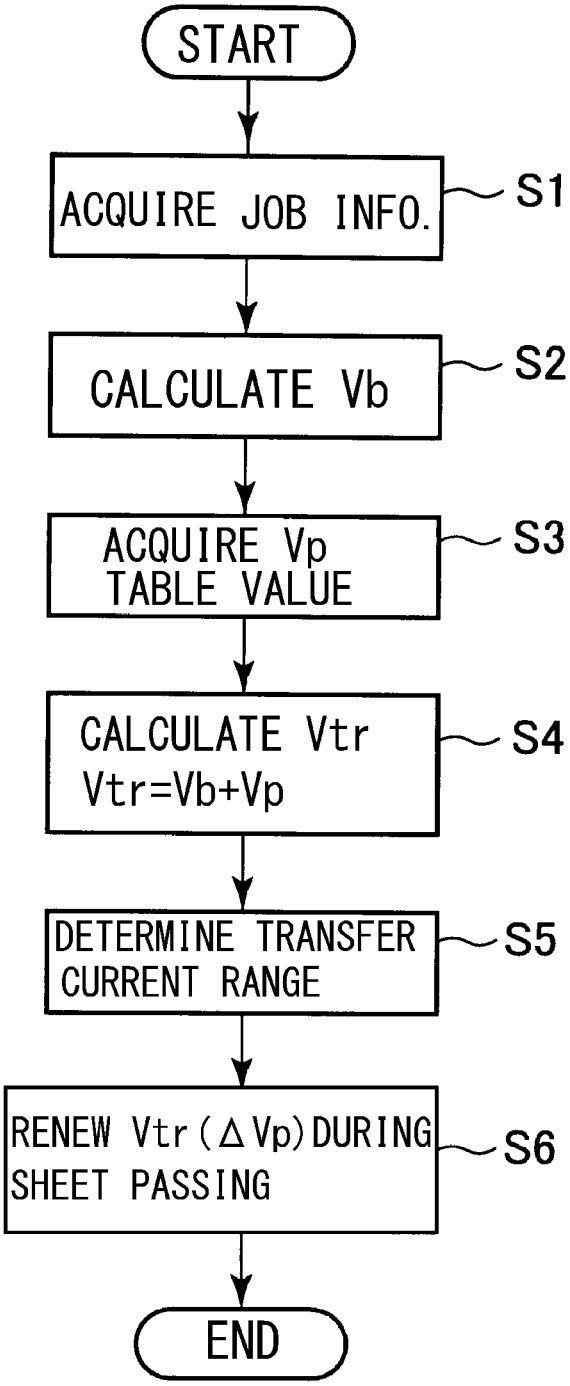
FIG. 4 is a flowchart for illustrating an outline of a secondary transfer voltage control.

Next, secondary transfer voltage control in this embodiment will be described. FIG. 4 is a flowchart showing an outline of a procedure of the secondary transfer voltage control in this embodiment. In FIG. 4, of pieces of control executed by the controller 50 when a job is executed, a procedure relating to the secondary transfer voltage control is shown in a simplified manner, and other many pieces of control during the execution of the job is omitted from illustration. This is true for flowcharts of FIGS. 11, 12 and 18 described later. FIG. 4 shows, as an example, the case where a job for forming an image on a single recording material P is executed.

First, when the controller 50 acquires information of the job from the operating portion 31 or the external device 200, the controller 50 causes the image forming apparatus to start the job (S1). In this embodiment, the following pieces of information is included in information on this job. That is, the pieces of information image information designated by the operator, and information on the recording material P on which the image is formed. The information on the recording material P includes a size (width, length) of the recording material P information (thickness, basis weight) relating to a thickness of the recording material P, and information (paper kind category) relating to a surface property of the recording material P such that whether or not the recording material P is coated paper. The controller 50 causes the RAM 52 to store this information on the job.

Then, the controller 50 acquires a base voltage Vb which is a voltage to be outputted from the secondary transfer voltage source 20 in order to cause a target current Itarget to flow in a state in which there is no recording material P at the secondary transfer portion N2 and causes the RAM 52 to store the base voltage Vb (S2). This base voltage Vb corresponds to a secondary transfer portion part voltage which is a transfer voltage corresponding to an electric resistance of the secondary transfer portion N2 (principally the secondary transfer roller 8 in this embodiment). In the ROM 53, information indicating a correlation between the environmental information and the target current Itarget for transferring the toner image from the intermediary transfer belt 7 onto the recording material P is stored. In this embodiment, this information is set as a table data showing the target current Itarget for each of sections of an ambient water content. This table data has been acquired by an experiment or the like in advance. The controller 50 acquires environmental information (temperature, humidity) detected by the environmental sensor 32. Further, the controller 50 is capable of acquiring the ambient water content on the basis of the environmental information (temperature, humidity) detected by the environmental sensor 32. The controller 50 acquires the target current Itarget corresponding to the environment from the information indicating the relationship (correlation) between the environmental information and the target current Itarget.

Then, the controller 50 acquires information on the electric resistance of the secondary transfer portion N2 (principally the secondary transfer roller 8 in this embodiment) before the toner image on the intermediary transfer belt and the recording material P on which the toner image is to be transferred reach the secondary transfer portion N2, and then acquires the base voltage Vb corresponding to the target current Itarget, on the basis of a the information. In this embodiment, the base voltage Vb is acquired by the following ATVC (active transfer voltage control). In a state in which the secondary transfer roller 8 and the intermediary transfer belt 7 are brought into contact with each other, a predetermined voltage (test voltage) or a predetermined current (test current) is applied from the secondary voltage source 20 to the secondary transfer roller 8. Further, a current value when the predetermined voltage is supplied or a voltage value when the predetermined current is supplied is detected. For example, test voltages or test currents of a plurality of a plurality of levels are supplied, so that a voltage-current characteristic which is a relationship between the voltage and the current is acquired, and then on the basis of the voltage-current characteristic, the base voltage Vb corresponding to the target current Itarget is acquired. Or, as the test current, for example, the target current Itarget is supplied, and an output voltage value of the secondary transfer voltage source may also be acquired as the base voltage Vb.

Then, the controller 50 acquires a recording material part voltage Vp which is a voltage to be outputted from the secondary transfer voltage source 20 by addition of a voltage corresponding to the electric resistance of the recording material P, and causes the RAM 52 to store the recording material part voltage Vp (S3). In the ROM 53, as shown in FIG. 5, information for acquiring a recording material sharing voltage Vp is stored. In this embodiment, this information is set as a table data showing a relationship between ambient water content and the recording material part voltage Vp for each of sections of a basis weight of the recording material P. This table data for acquiring the recording material part voltage Vp is acquired by an experiment in advance. The controller 50 acquires the ambient water content on the basis of the environmental information (temperature, humidity) detected by the environmental sensor 32. Further, the controller 50 acquires the recording material part voltage Vp from the table data on the basis of the information on the basis weight of the recording material P included in the information on the job acquired in S1 and the environmental information described above. Incidentally, the recording material part voltage (a transfer voltage corresponding to the electric resistance of the recording material P) Vp also changes a surface property of the recording material P as a factor other than the information (basis weight) relating to the thickness of the recording material P. For that reason, the table data may also be set so that the recording material part voltage Vp changes also depending on information relating to the surface property of the recording material P. Further, in this embodiment, the information relating to the thickness of the recording material P (and further the information relating to the surface property of the recording material P) are included in the information on the job acquired in S101. However, the image forming apparatus 100 may also be provided with a measuring means for detecting the thickness of the recording material P and the surface property of the recording material P, and on the basis of information acquired by this measuring means, the recording material part voltage Vp may also be acquired.

Then, the controller 50 acquires an initial value of a target value (target voltage) of a secondary transfer voltage Vtr applied from the secondary transfer voltage source 20 to the secondary transfer roller 8 during the sheet passing and causes the RAM 52 to store the initial value (S4). That is, until the recording material P reaches the secondary transfer portion N2, the controller 50 acquires, as the initial value of the secondary transfer voltage Vtr, Vb+Vp obtained by adding the base voltage Vb and the recording material part voltage Vp and causes the RAM 52 to store the value of Vb+Vp. Then, the controller 50 prepares for timing when the recording material P reaches the secondary transfer portion N2.

Then, the controller 50 determines the upper limit and the lower limit (predetermined current range) of the secondary transfer current during the sheet passing (S5). In the ROM 53, as shown in FIG. 6, information for acquiring a range of a current which may be passed through the secondary transfer portion N2 during the sheet passing from the viewpoint of suppression of the image defect is stored. In this embodiment, this information is set as a table data showing a relationship between the ambient water content, and the upper limit and the lower limit of the current which may be passed through the secondary transfer portion N2 during the sheet passing. This table data is acquired by an experiment or the like in advance. The controller 50 acquires the ambient water content on the basis of the environmental information detected by the environmental sensor 32. The controller 50 acquires a predetermined current range of the secondary transfer current during the sheet passing from the table data on the basis of the above-described environmental information.

Incidentally, the range of the current which may be passed through the secondary transfer portion N2 during the sheet passing changes depending on the dimension (width) of the recording material P. In FIG. 6, as an example, a table data set on the assumption that the recording material P is a recording material of 297 mm in dimension (width) corresponding to an A4 size. A plurality of table data may also be set depending on a width of the recording material P. Or, in the case where the width of the recording material P is different from a width corresponding to the A4 size, a value of the table data may also be corrected by a proportional calculation using a ratio of a width of the recording material P to be actually passed to the width corresponding to the A4 size and then may be used. Here, as the current flowing through the transfer portion when the recording material P passes through the secondary transfer portion N2, there are a sheet-passing-portion current and a non-sheet-passing-portion current. The sheet-passing-portion current is a current flowing through a region ("sheet-passing portion") where the recording material P passes through the secondary transfer portion N2 with respect to a direction substantially perpendicular to the feeding direction of the recording material P. Further, the non-sheet-passing-portion current is a current flowing through a region ("non-sheet-passing portion") where the recording material P does not pass through the secondary transfer portion N2 with respect to the direction substantially perpendicular to the recording material feeding direction. A current capable of being detected during the sheet passing is the sum of the sheet-passing-portion current and the non-sheet-portion current. For that reason, a range of a current which may be passed through the sheet-passing portion is set in advance, and a current flowing through the non-sheet-passing portion is acquired, and a predetermined current range may also be acquired by adding the current flowing through the non-sheet-passing portion and the range of the current which may be passed through the sheet-passing portion. The current flowing through the non-sheet-passing portion can be acquired in the following manner, for example. A current flowing in the case where the secondary transfer voltage Vtr is acquired is acquired by using information (voltage-control characteristic relating to the electric resistance of the secondary transfer portion N2 acquired in S2. Then, the current flowing through the non-sheet-passing portion from the above-acquired current by a proportional calculation using a ratio of a width of the non-sheet-passing portion to a width of the sheet-passing portion (i.e., a difference between the width of the secondary transfer roller 8 and the width of the recording material P). Further, the predetermined current range for suppressing the image defect changes in some instances also depending on a thickness and a surface property of the recording material P as a factor other than the environmental information. For that reason, the table data may also be set so that the range of the current changes also depending on information (basis weight) relating to the thickness of the recording material P or information relating to the surface property of the recording material P. The predetermined current range may also be set as a calculation formula. Further, the predetermined current range may also be set as a plurality of table data or calculation formulas for each of sizes of the recording materials P.

Then, the controller 50 causes the current detecting circuit 21 to detect the secondary transfer current during the sheet passing, and changes the secondary transfer voltage Vtr in the case where the detected secondary transfer current is out of the predetermined current range determined in S5 (limiter control) (S6). At this time, the controller 50 changes the secondary transfer voltage Vtr by adding an offset voltage described later to the value of Vb+Vp. In other words, this process corresponds to a change in secondary transfer voltage Vtr through a change in Vp of the value of Vb+Vp. In order to perform this operation, a high-voltage substrate for supplying the secondary transfer voltage is capable of repeating an operation such that a current is detected at a predetermined detection time and on the basis of a result thereof, switching of the high voltage is made at a predetermined response time.

Figure 8:
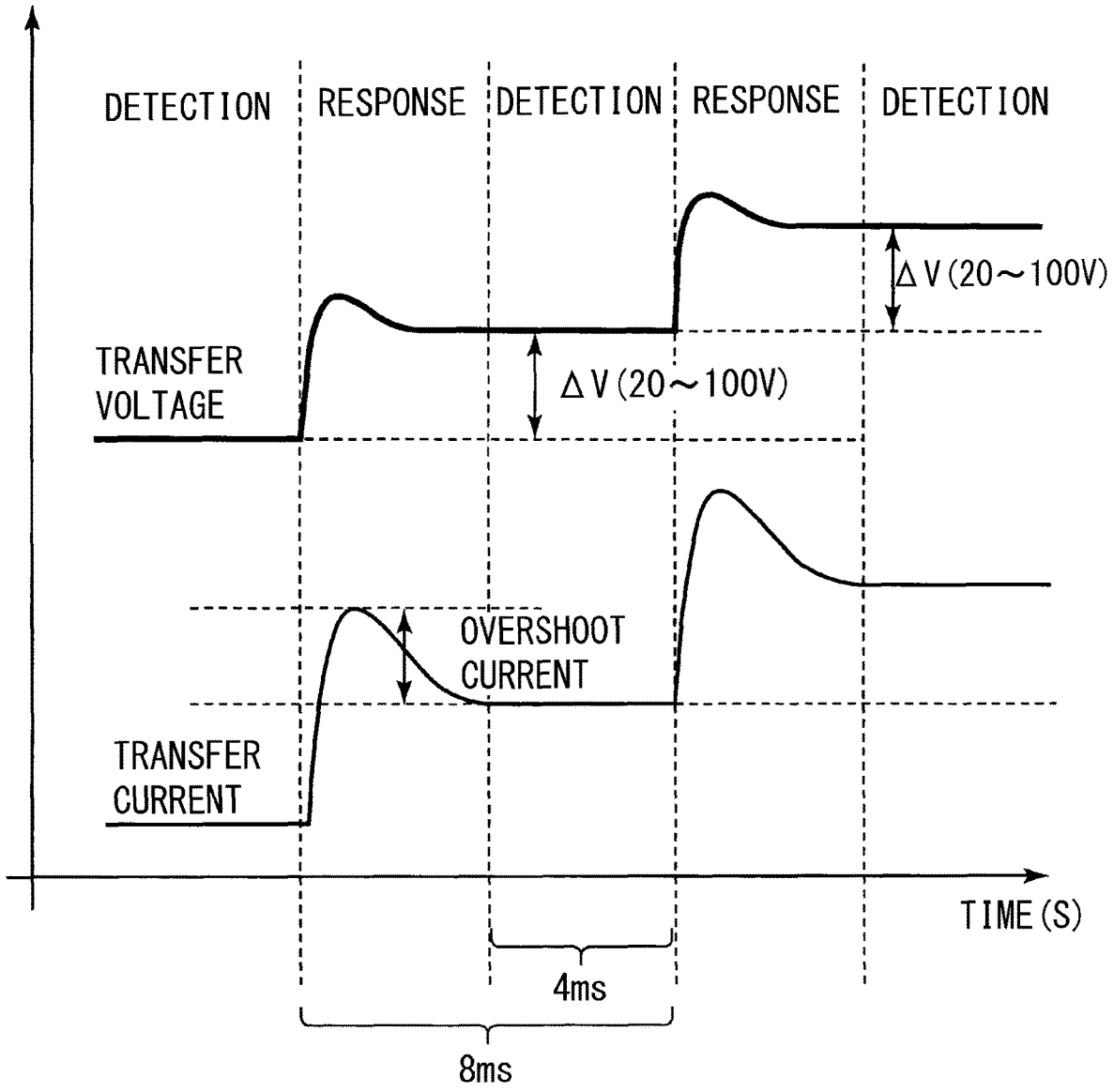
FIG. 8 is a time chart for illustrating a voltage changing method in limiter control.

Further, in the limiter control (current limiter control), the detection time (first period) in which detection of the transfer current is carried out and the response time (second period) in which a signal for changing the transfer voltage on the basis of a detection result of the transfer current in the detection time is outputted, the controller 50 awaits response thereof are repeated. FIG. 8 schematically shows an example of progression of the transfer control and the transfer voltage in the limiter control. Further, this operation is carried out by outputting a signal of changing a voltage output from the controller 50 to the secondary transfer voltage source 20, on the basis of a signal indicating a detection result of the current (inputted from the current detecting circuit 21 in the detection time (first period). FIG. 8 shows an example when the secondary transfer voltage is changed in the case where the secondary transfer current detected during the sheet passing is below the lower limit. As shown in FIG. 8, in the case where the secondary transfer current is still below the lower limit when a predetermined secondary transfer voltage is applied for 8 ms ((response time)+(detection time)), the secondary transfer voltage is changed in the following manner. That is, the secondary transfer voltage is changed to a secondary transfer voltage obtained by adding a predetermined voltage fluctuation range (ΔV in the figure) to the predetermined secondary transfer voltage. Further, this change of the secondary transfer voltage is repetitively carried out until the secondary transfer current detected during the sheet passing reaches the lower limit. This is also true for the case where the secondary transfer current detected during the sheet passing exceeds the upper limit. In the case where the secondary transfer current still exceeds the upper limit when a predetermined secondary transfer voltage is applied for 8 ms ((response time)+(detection time)), the secondary transfer voltage is changed in the following manner. That is, the secondary transfer voltage is changed to a secondary transfer voltage obtained by subtracting a predetermined voltage fluctuation range (ΔV in the figure) from the predetermined secondary transfer voltage. Further, this change of the secondary transfer voltage is repetitively carried out until the secondary transfer current detected during the sheet passing reaches the upper limit.

Incidentally, although the detection time and the response time vary depend on a performance of the high voltage substrate, each of the detection time and the response time is about 10 msec. In this embodiment, each the detection time and the response time is 8 msec.

Here, the voltage fluctuation range per once in the limiter control described above is referred to as a "voltage fluctuation range ΔVps". Further, a voltage change amount in the limiter control which is a cumulative value (ΔVps which is a positive (+) value is added in the case where the voltage is raised and ΔVps which is a negative (−) value is added in the case where the voltage is lowered) of this voltage fluctuation range ΔVps is referred to as an "offset voltage ΔVp". This offset voltage ΔVp corresponds to a difference between an initial value of the secondary transfer voltage Vtr obtained by adding the base voltage Vb and the recording material part voltage Vp and the secondary transfer voltage Vtr after being changed by the limiter control.

Then, the controller 50 repetitively carries out the limiter control during the sheet passing until output of a desired image in a job is ended, and when the output of the desired image in the job is ended, the controller 50 ends the job.

4. Succession of Offset Voltage

As described above, as regards the secondary transfer current during the sheet passing, the predetermined current range in which the image defect can be suppressed is determined in advance. In the case where the detected secondary transfer current is out of this predetermined current range, the image defect occurs.

As can be understood from the above-described method of the limiter control, in the limiter control, a time lag arises in a detect from detection that the transfer current is out of the predetermined range until the change in transfer voltage is completed. For that reason, as described above, the image defect due to the excess and deficiency of the transfer current occurs in a region in which the recording material passes through the transfer portion in the period until the transfer voltage changes is completed and in which the transfer output is out of the proper range. Further, as described above, in the case where such an image defect occurs in the last job, there is a high possibility that a similar image defect occurs also in a subsequent job. This is because it would be considered that there is a high possibility that the recording material used in the subsequent job is the same in kind as the recording material used in the last job and a left-standing state of the recording material used in the subsequent job is also similar to the left-standing state of the recording material used in the last job.

Figure 9:
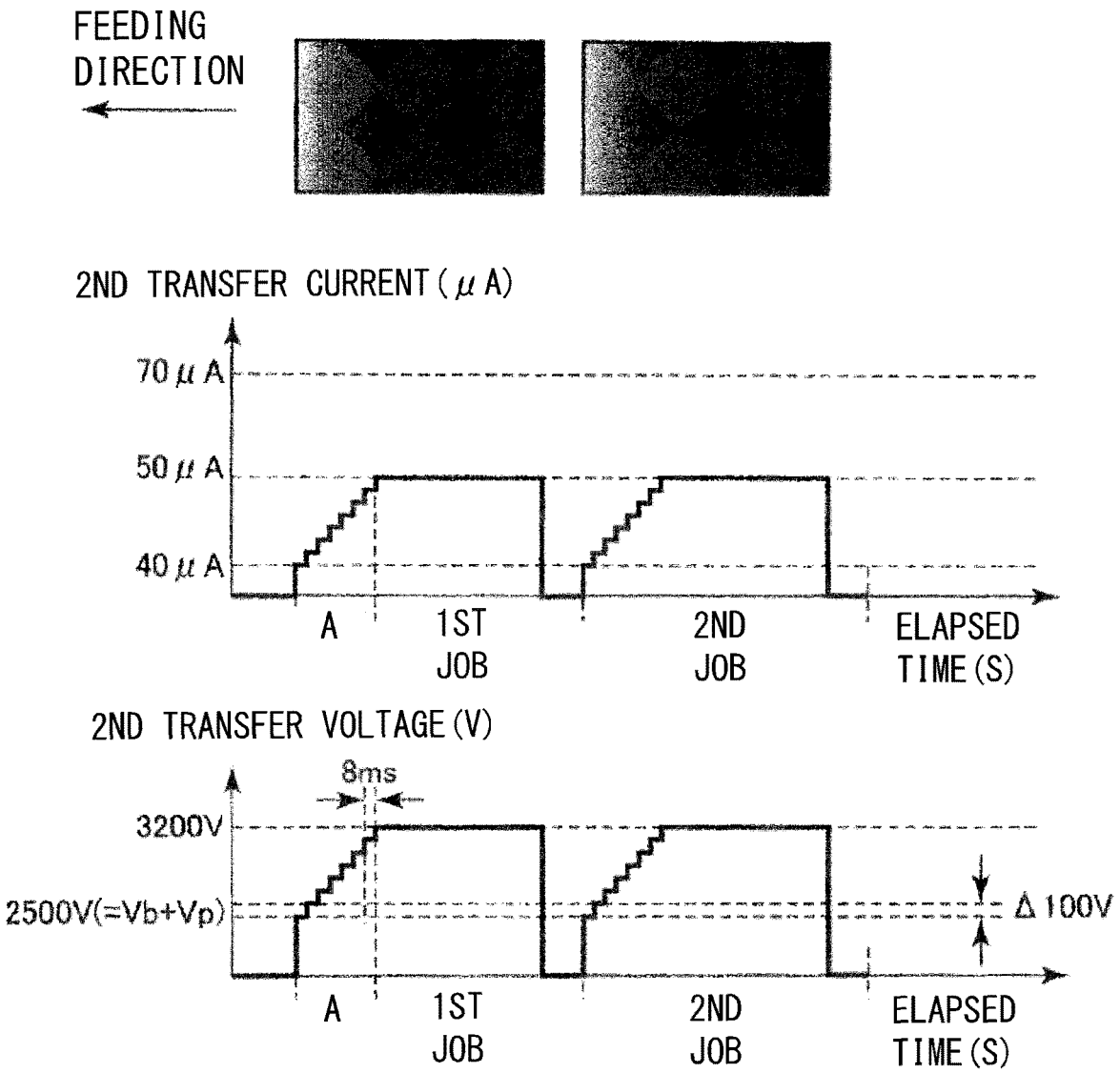
FIG. 9 includes time charts and schematic view of images, for illustrating a problem to be solved by the present invention.

FIG. 9 schematically shows changes of the secondary transfer voltage and the secondary transfer current and a state of an occurrence of the image defect in two jobs executed intermittently in the case where control in this embodiment as described later is not carried out. In FIG. 9, an example of the case where two jobs each in which an image is formed on a single recording material P are intermittently carried out using A3-size paper of 90 g/m$^2$ as the recording material P in an environment (water content: 0.9 g/kg or less) of 23° C. and 5% RH (single sheet intermittent operation). The two jobs are intermittently executed with an interval of less than one minute (for example 1-5 sec), and the image forming apparatus 100 does not enter a sleep state between the two jobs. Further, FIG. 9 shows an example of the case where the secondary transfer current detected during sheet passing of the first job is below a lower limit current. Incidentally, for the recording material P or the image formed on the recording material P, a leading end and a trailing end refer to those with respect to a feeding direction of the recording material P.

In an example of FIG. 9, a lower limit value of the predetermined current range is 50 μA, an upper limit value of the predetermined current range is 70 μA, the target current Itarget of the secondary transfer current is 60 μA, and the initial value of the secondary transfer voltage Vtr determined depending on the target current Itarget is 2500 V. This secondary transfer voltage Vtr is the sum of values of the base voltage Vb (=1500 V) and the recording material part voltage Vp (=1000 V). The target current Itarget is determined depending on environmental information. The base voltage Vb is determined depending on the target current on the basis of information relating to the electric resistance of the secondary transfer portion (principally the secondary transfer roller 8 in this embodiment) acquired in an absent state of the recording material P at the secondary transfer portion N2. Further, the recording material part voltage Vp is determined depending on the basis weight of the recording material P. The recording material part voltage Vp is set in advance as table data showing a relationship between a value relating to a normal recording material P and an environment.

The secondary transfer current detected when the above-described secondary transfer voltage, Vtr is acquired to the recording material P in the first job is 40 μA which is below 50 μA as a lower limit value). This occurs in the case where as regards normal (standard) recording materials P when table values of the recording material part voltages Vp are detected, the basis weight is the same but the electric resistance is extremely high due to drying or occurs in the like case.

The secondary transfer current detected during the passing of the leading end of the recording material P in the first job is below 50 μA which is the lower limit, and therefore, the secondary transfer voltage is changed to 2600 V (2500 V+(voltage fluctuation range) ΔVps (=100 V)), and then detection of the secondary transfer current is carried out again. Thereafter, the secondary transfer voltage Vtr is changed so as to be increased every voltage fluctuation range ΔVps (=100 V) until the secondary transfer current reaches the lower limit. Then, in the case where the secondary transfer voltage reaches 3200 V, the secondary transfer current is reaches 50 μA which is the lower limit. For that reason, in this case, the change of the secondary transfer voltage Vtr is executed 7 times. The change of the secondary transfer voltage Vtr is stopped after the secondary transfer current reaches the lower limit, and the secondary transfer voltage Vtv is kept at 3200 V, and then the secondary transfer of the toner image is carried out toward the trailing end of the recording material P, in the first job.

That is, in an example of FIG. 9, in a section A from the leading end of the recording material P in the first job in which the secondary transfer current is 40 μA until the secondary transfer current reaches 50 μA which is the lower limit, the image defect such as the poor image density (transfer void) due to insufficient transfer current occurs. Further, in the example of FIG. 9, also in the second job, the secondary transfer voltage control similar to the secondary transfer voltage control in the first job is carried out, and therefore, the image defect such as the poor image density (transfer void) due to the insufficient transfer current occurs similarly as in the first job. This is because the recording material P used in the first job and the recording material P used in the second job are the same recording material P, and the left-standing states of these recording material P are also the same. Incidentally, in FIG. 9, although the image defect occurring due to the insufficient transfer current was described as an example, but a similar problem can also arise as to the image defect due to excessive transfer current.

Therefore, in this embodiment, in the case where the job is executed subsequently to the last job, the offset voltage ΔVp in the limiter control in the last job is succeeded by the subsequent job, and the secondary transfer voltage Vtr in the subsequent job is set. By this, it is possible to suppress that the image defect similar to the image defect occurred due to the excess and deficiency of the transfer current in the last job repeatedly occurs in the subsequent job.

In this embodiment, by using the offset voltage ΔVp substantially equal to the offset voltage ΔVp in the limiter control in the last job, the secondary transfer voltage Vtr in the subsequent job is set. Particularly, in this embodiment, a value of the secondary transfer voltage Vtr acquired to the leading end of the first recording material P in the subsequent job is set at a voltage value obtained by adding the offset voltage ΔVp in the limiter control in the last job to a voltage value which is the sum of the base voltage Vb and the recording material part voltage Vp. For example, in the case of performing the single sheet intermittent operation, the secondary transfer voltage Vtr after being changed by the limiter control in the last job and the secondary transfer voltage Vtr to be acquired to the leading end of the recording material P in the subsequent job are made the substantially same voltage value. However, setting of the secondary transfer voltage Vtr by succession of the offset voltage ΔVp in the limiter control in the last job is not limited to setting mode by using the output ΔVp equal to the offset voltage ΔVp in the limiter control in the last job. That is, in the case where the change in secondary transfer voltage Vtr by the limiter control in the last job is made, the secondary transfer voltage Vtr in the subsequent job can be determined on the basis of a change amount of the secondary transfer voltage Vtr by the limiter control in the last job. In this embodiment, for simplification, determination of the secondary transfer voltage Vtr in the subsequent job on the basis of the change amount of the secondary transfer voltage Vtr by the limiter control in the last job is simply referred to as "succession of offset voltage ΔVp" in some instances.

Figure 7:
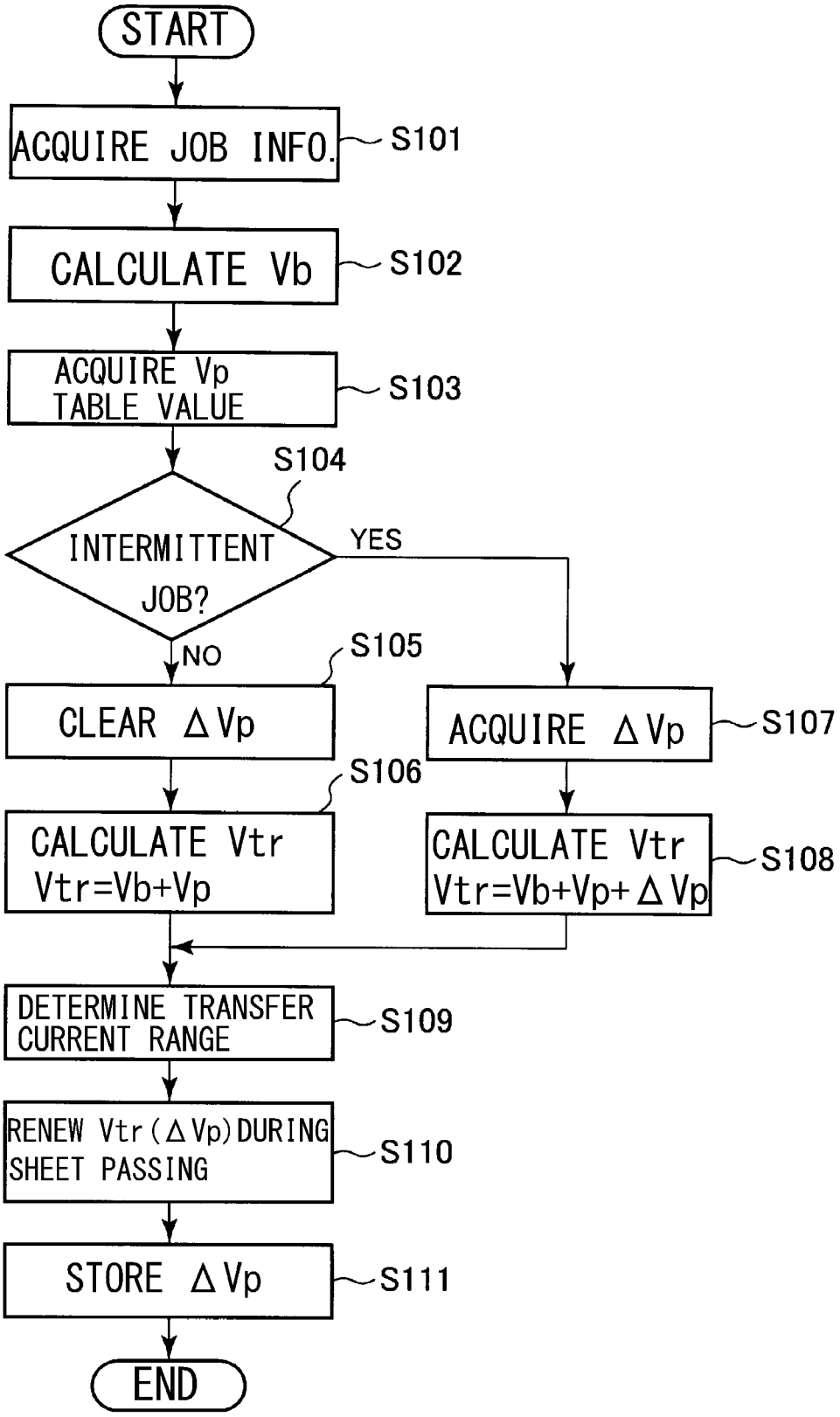
FIG. 7 is a flowchart for illustrating the secondary transfer voltage control in accordance with the present invention.

FIG. 7 is a flowchart showing an outline of a procedure of secondary transfer voltage control in this embodiment including a process of succession of offset voltage ΔVp in the last job. FIG. 7 shows, as an example, the case where a job for forming an image on a single recording material P is executed. Description of a procedure similar to the procedure of FIG. 4 will be omitted.

Processes of S101 to S103 of FIG. 7 are similar to the processes of S1 to S3 of FIG. 4, respectively.

The controller 50 discriminates whether or not this (subsequent job satisfies a predetermined condition in relation to the last job (S104). This predetermined condition is, in summary, a condition for discriminating whether or not in this job, the succession of the offset voltage ΔVp in the last job is appropriate. That is, the predetermined condition is a condition for discriminating whether or not the offset voltage ΔVp in the last job is succeeded by this job and the secondary transfer voltage Vtr capable of suppressing the image defect of the leading end portion (the above-described section A) of a first recording material P in this job can be set with sufficient accuracy. Particularly, in this embodiment, the predetermined condition is a condition for discriminating whether or not a state of the recording material P to be used in this job is changed to the extent that compared with a state of the recording material P used in the last job, the succession of the offset voltage ΔVp in the last job is not appropriate or whether or not it is difficult to predict the state of the recording material P to be used in this job.

The predetermined condition relating to this state of the recording material P will be described specifically later. Further, other examples of the predetermined condition of S104 will be described later in embodiments 2 to 7.

In the case where the controller 50 discriminated that the predetermined condition is not satisfied in S104, the controller 50 clears the offset voltage ΔVp of the last job stored in the RAM 52 (the controller 50 resets the offset voltage ΔVp to 0 in this embodiment) (S105). Then, the controller 50 acquires, as an initial value of the secondary transfer voltage Vtr in this job, a value of Vb+Vp by adding the base voltage Vb and the recording material part voltage Vp (table value) and causes the RAM 52 to store the value of Vb+Vp (S106). On the other hand, in the case where the controller 50 discriminated that the predetermined condition is satisfied in S104, the controller 50 acquires the offset voltage ΔVp of the last job stored in the RAM 52 (S107). Then, the controller 50 acquires, as an initial value of the secondary transfer voltage Vtr in this job, a value of Vb+Vp+ΔVp by adding the base voltage Vb, the recording material part voltage Vp (table value) and the offset voltage ΔVp in the last job and causes the RAM 52 to store the value of Vb+Vp+ΔVp (S108).

Processes S109 and S110 of FIG. 7 are similar to the processes S5 and S6 of FIG. 4, respectively.

Further, the controller 50 repetitively carries out the limiter control during the sheet passing until offset voltage of a desired image in the job is ended, and when the offset voltage of the desired image in the job is ended, the controller 50 causes the RAM 52 to store the offset voltage ΔVp renewed during the sheet passing (S111), and then ends the job.

Incidentally, in this embodiment, in order to facilitate understanding of the present invention, in the case where the secondary transfer voltage Vtr is changed by the limiter control during the sheet passing, description was made by that the offset voltage ΔVp is renewed. However, a processing method of information on the change amount of the secondary transfer voltage Vtr in the limiter control is not limited thereto. As described above, the process of changing the secondary transfer voltage Vtr by adding the offset voltage ΔVp to the value of Vb+Vp corresponds to a change in secondary transfer voltage Vtr made by changing Vp of the value Vb+Vp. That is, the recording material part voltage Vp is capable of being gradually renewed as a recording material part voltage ΔVp' (=Vp+ΔVps+ΔVps+ . . . ) after the change. In this case, a difference between Vp before the change and Vp' after the change corresponds to the offset voltage ΔVp which is the change amount of the secondary transfer voltage Vtr by the limiter control. In this case, the succession of the offset voltage ΔVp in the last job also includes, as the recording material part voltage Vp in the subsequent job, use of Vp' (corresponding to Vp+ΔVp) stored in the last job. Further, non-succession of the offset voltage Vp in the last job also includes the case of ΔVp=0 although the process of acquiring the value Vb+Vp+ΔVp as the secondary transfer voltage Vtr is carried out similarly as in the case of the succession.

Figure 10:
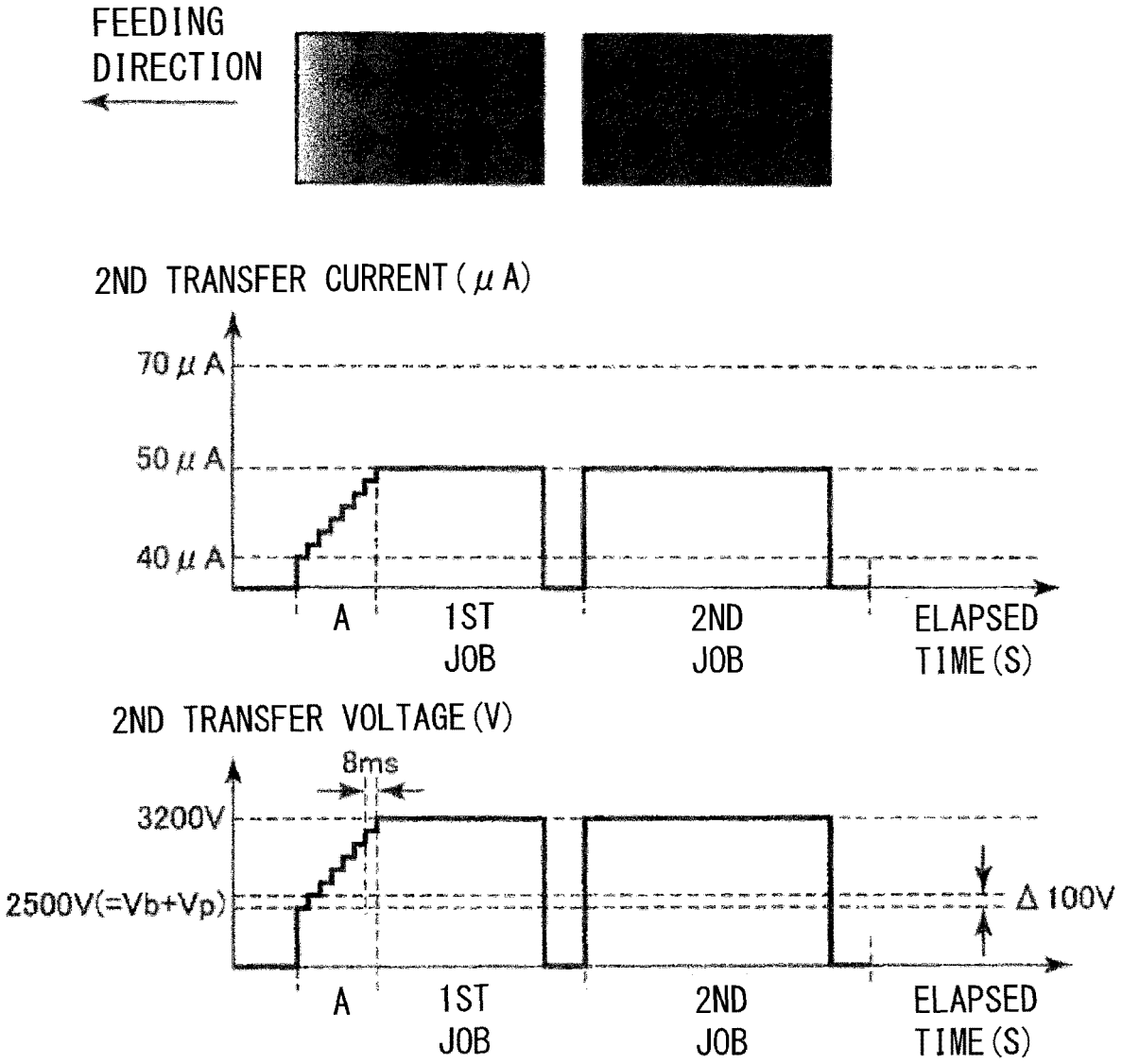
FIG. 10 includes time charts and a schematic view of images, for illustrating an effect of an embodiment of the present invention.

FIG. 10 is a schematic similar to FIG. 9 in the case where the secondary transfer voltage Vtr applied to the leading end of the recording material P in the second job is set by succeeding the offset voltage ΔVp in the first job when the second job is executed intermittently. In an example of FIG. 10, the secondary transfer voltage Vtr applied to the leading end of the recording material P in the second job is made the substantially same value as the secondary transfer voltage Vtr after being changed by the limiter control in the first job. In this case, in the section A in the first job, similarly as in the case of FIG. 9, the image defect due to the insufficient transfer current occurs. However, in the second job, the secondary transfer voltage Vtr=3200 V obtained by adding the output ΔVp stored in the first job to the voltage value obtained by the sum of the base voltage Vb and the recording material part voltage Vp (table value) is applied to the leading end of the recording material P toward the trailing end of the recording material P. For that reason, the image defect does not occur in an entire region from the leading end to the trailing end of the recording material P.

5. Condition for Succeeding Offset Voltage ΔVp

Incidentally, in the case where the jobs are executed intermittently as in the example of FIG. 10, the kind and the drying state of the recording material P are unchanged. For that reason, by setting the secondary transfer voltage Vtr in the subsequent job by succeeding the offset voltage ΔVp in the last job, the image defect is suppressed in the subsequent job and thus a proper image can be outputted in the subsequent job. However, in the case where the recording material P used in the job is changed or supplemented by an operator in a period from an end of the last job to a start of the subsequent job or in the like case, the kind and the drying state of the recording material P change, so that there is a possibility that the electric resistance of the recording material P changes. When the secondary transfer voltage Vtr is set by succeeding the output ΔVp in the last job although the state of the recording material P changes, the secondary transfer current deviates from a proper range, so that there is a possibility that the image defect occurs. For that reason, in the case where a change in state of the recording material P from the last job is predicted, the offset voltage ΔVp of the last job may preferably be not succeeded.

Figure 11:
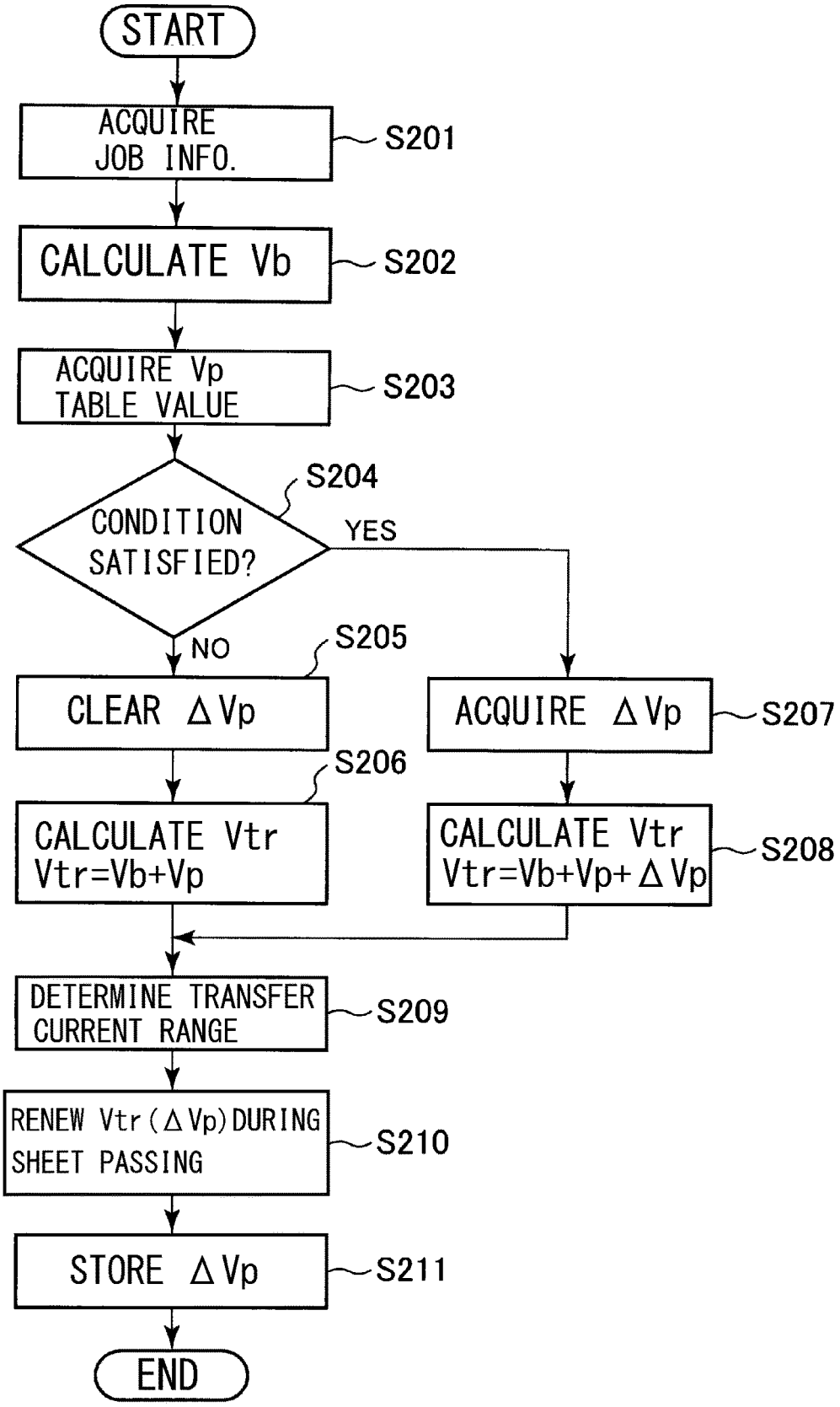
FIG. 11 is a flowchart of secondary transfer voltage control in an embodiment 1.

FIG. 11 is a flowchart showing an outline of a procedure of secondary transfer voltage control in this embodiment in which as the predetermined condition of S104 of FIG. 7, a condition relating to the state of the recording material P as described above is used. FIG. 11 shows, as an example, the case where a job for forming an image on a single recording material P is executed. Description of a procedure similar to the procedure of FIG. 7 will be omitted.

Processes of S201 to S203 and S205 to S211 of FIG. 11 are similar to the processes of S101 to S103 and S105 and S111 of FIG. 7, respectively.

The controller 50 discriminates whether or not the state of the recording material P satisfies a predetermined condition on the basis of the information on the job acquired in S201 (S204).

A specific example of the predetermined condition relating to this state of the recording material P will be described specifically later. In the case where the controller 50 discriminated that the predetermined condition is not satisfied in S204, the controller 50 clears the offset voltage ΔVp of the last job stored in the RAM 52 (S205). Then, the controller 50 acquires, as an initial value of the secondary transfer voltage Vtr in this job, a value of Vb+Vp by adding the base voltage Vb and the recording material part voltage Vp (table value) and causes the RAM 52 to store the value of Vb+Vp (S206). On the other hand, in the case where the controller 50 discriminated that the predetermined condition is satisfied in S204, the controller 50 acquires the offset voltage ΔVp of the last job stored in the RAM 52 (S207). Then, the controller 50 acquires, as an initial value of the secondary transfer voltage Vtr in this job, a value of Vb+Vp+ΔVp by adding the base voltage Vb, the recording material part voltage Vp (table value) and the offset voltage ΔVp in the last job and causes the RAM 52 to store the value of Vb+Vp+ΔVp (S208).

Incidentally, in this embodiment, in the case where the controller 50 discriminated that the predetermined condition is satisfied in S204, an initial value of the secondary transfer voltage Vtr in this job was set at the value of Vb+Vp+ΔVp (coefficient of ΔVp is 1). That is, the offset voltage ΔVp itself in the last job is succeeded, but the present invention is not limited thereto. For example, the initial value may also be set at a value of Vb+Vp+ΔVp×first efficient (predetermined coefficient: value other than 1). Further, in this embodiment, in the case where the controller 50 discriminated that the predetermined condition is not satisfied in S204, the offset voltage ΔVp in the last job stored in the RAM 52 is cleared, but the present invention is not limited thereto. For example, the offset voltage ΔVp may also be substantially cleared by setting the initial value at a value of Vb+Vp+ΔVp×second coefficient. Here, the second coefficient is a value smaller than the first coefficient and may preferably be a value close to 0.

Thus, by discriminating the change in state of the recording material P, application of the proper secondary transfer voltage can be carried out from the leading end of the recording material P, so that it is possible to suppress the occurrence of the image defect due to the excess and deficiency of the transfer current at the leading end portion of the recording material P.

6. Specific Example of Predetermined Condition Relating to State of Recording Material Next, a specific example of the predetermined condition relating to the state of the recording material P in this embodiment will be described.

6-1. Opening and Closing of Cassette

During image formation, the recording material P is sent and fed one by one from the cassette 11 or a manual feeding tray (manual feeding portion) (not shown) as the feeding portion (sheet feeding portion, accommodating portion). Here, in the image forming apparatus 100, for example, as an open/close detecting portion for detecting opening and closing of the cassette 11 as the feeding portion, an open/close detecting sensor 41 (FIG. 3) constituted by an optical sensor or the like is provided in some instances. Incidentally, an open state of the cassette 11 is a state in which the recording material P can be placed in and taken out of the cassette 11 for the purposes of replenishment, exchange and the like, and a closed state of the cassette 11 is a state in which the recording material P can be fed from the cassette 11 for forming the image on the recording material P. Further, detection of the open/close state of the cassette 11 refers to detection either one of a state change from the closed state to the open state and a state change from the open state to the closed state. The open/close detecting sensor 41 inputs, into the controller 50, a signal indicating that the opening or closing of the cassette 11 is carried out. The controller 50 is capable of discriminating whether or not the opening or closing of the cassette 11 is carried out, by the signal from the open/close detecting sensor 41. Incidentally, the operator opens and closes the cassette 11 in general in order to replenish the recording materials P into the cassette 11 or to perform paper jam clearance. In the case where the open/close of the cassette 11 is not carried out in a period from an end of the last job until the subsequent job (this job) is started, there is a high possibility that the kind and the drying state of the recording material P in the cassette 11 are the same as those of the recording material P fed in the last job. For that reason, in this case, there is a high possibility that the secondary transfer voltage ($Vb+Vp+\Delta Vp$) adjusted in the last job is also a proper secondary transfer voltage in the subsequent job (this job).

Accordingly, as the predetermined condition relating to the state of the recording material P in S204 of FIG. 11, it is possible to use a condition such that the cassette 11 is not opened nor closed in the period from the end of the last job until the subsequent job is started. Incidentally, when the signal indicating that the open/close of the cassette 11 is carried out is inputted from the open/close detecting sensor 41, the controller 50 causes the RAM 52 to store the signal indicating that the open/close of the cassette is carried out. This information is cleared every execution of the job (the open/close detecting sensor 41 is placed in a state in which the sensor 41 indicates that the open/close of the cassette 11 is not carried out). On the basis of this information, the controller 50 can discriminate whether or not the open/close of the cassette 11 is carried out between the jobs.

Thus, in the case where the open/close of the cassette is not carried out and there is a high possibility that the kind and the drying state of the recording material P in the cassette are unchanged, it is possible to succeed the offset voltage $\Delta Vp$ in the last job. By this, it is possible to perform application of the proper secondary transfer voltage from the leading end of the first recording material P in the subsequent job, so that the occurrence of the image defect due to the excess and deficiency of the transfer current at the leading end portion of the recording material P can be suppressed.

6-2. Feeding from the Same Feeding Portion

The image forming apparatus 100 is provided with a plurality of feeding portions in some instances, and the operator is capable of arbitrarily select feeding of the recording material P from which feeding portion in the operating portion 31 or the external device 200. Further, for each of the feeding portions, it is possible to set the kind (basis weight or surface property) of the recording material P accommodated in the associated in the associated feeding portion and to accommodate the recording materials P in kind in the feeding portions, respectively. On the basis of information designating the feeding portion included in the information on the job, the controller 50 is capable of discriminating whether. Incidentally, as the plurality of feeding portions, for example, it is possible to cite the case where a plurality of cassettes 11 are provided, the case where a plurality of manual feeding trays (not shown) are provided and the case where a single or plurality cassettes 11 and a single or plurality of manual feeding trays (not shown) are provided. Here, for example, as shown in FIG. 5, as regards the secondary transfer voltage applied during the image formation, a table value is set for each of the kinds (for example basis weights) of the recording materials P. This is because an electric resistance value is different depending on the basis weight of the recording material P and correspondingly a proper secondary transfer voltage also changes. For that reason, in the case where the feeding portions for feeding the recording materials P are different from each other between the last job and the subsequent job (this job).

Accordingly, as the predetermined condition relating to the state of the recording material P in S204 of FIG. 11, it is possible to use a condition such that the feeding portions for feeding the recording materials P are the same between the last job and this job. Incidentally, the controller 50 causes the RAM 52 to store the information on the last job at least until the discrimination of the above-described condition is made. On the basis of the information on the recording material P (information on the feeding portion for feeding the recording material P) included in each of the information on the last job and the information on this job, the controller 50 is capable of discriminating whether or not the feeding portions are the same between the jobs.

Thus, in the case where the recording materials P are fed from the same feeding portion and these is a high possibility that the kind and the drying state of the recording material P fed are unchanged, it is possible to succeed the output $\Delta Vp$ in the last job. By this, it is possible to perform application of the proper secondary transfer voltage from the leading end of the first recording material P in the subsequent job, so that it is possible to suppress the occurrence of the image defect due to the excess and deficiency of the transfer current at the leading end portion of the recording material P.

6-3. Change in Setting of Kind of Recording Material

As described in 6-2. mentioned above, for each of the feeding portions (which may also be a single feeding portion), the operator is capable of setting the kind (basis weight or surface property) of the recording material P accommodated in the associated feeding portion, through the operating portion 31 or the like as a setting portion. Further, as described in 6-2. mentioned above, as regards the secondary transfer voltage applied during the image formation, a proper value is determined every kind (for example the basis weight) of the recording material P. For that reason, the kinds of the recording materials P are different from each other between the last job and the subsequent job, there is a possibility that the proper secondary transfer voltage changes.

Accordingly, as the predetermined condition relating to the state of the recording material P in S204 of FIG. 11, it is possible to use a condition such that settings of the kinds of the recording materials P to be fed are the same between the last job and this job. Incidentally, the controller 50 causes the RAM 52 to store the information on the last job until at least the discrimination of the above-described condition is made. On the basis of the information on the recording material P (information on setting of the kind of the recording material P) included in each of the information on the last job and the information on this job, the controller 50 is capable of discriminating whether or not settings of the kinds of the recording materials P are the same between the last job and this job. In the case of this embodiment, the feeding portions in the last job and this job may also be the same or different from each other. In the case where the feeding portions are the same, between the last job and this job, the setting of the kind of the recording material P accommodated in the feeding portion is changed.

Thus, in the case where the recording material P of the same kind is used and there is a high possibility that the proper secondary transfer voltage is the same, it is possible to succeed the offset voltage ΔVp in the last job. By this, it is possible to perform the application of the proper secondary transfer voltage from the leading end of the first recording material P in the subsequent job, so that it is possible to suppress the occurrence of the image defect due to the excess and deficiency of the transfer current at the leading end portion of the recording material P.

6-4. Recording Material Absence Detection

The image forming apparatus 100 is provided with a recording material sensor 42 (FIG. 3) as a recording material detecting portion for detecting the presence or absence of the recording material P at the feeding portion in some instances. The recording material sensor 42 detects the presence or absence of the recording material P remaining in the feeding portion. Incidentally, detection of the presence or absence of the recording material P refers to detection of either one of the absence of the recording material P and the presence of the recording material P. The recording material sensor 42 inputs, into the controller 50, a signal indicating the presence or absence of the recording material P at the feeding portion. By the signal from the recording material sensor 42, the controller 50 is capable of discriminating whether or not the recording material P in the example the cassette 11 as the feeding portion is used up (or remains). In the case where in a period from an end of the last job until the subsequent job (this job) is started, the absence of the recording material P in the feeding portion for feeding the recording materials P in both the jobs is not detected, there is a high possibility that the kind and the drying state of the recording material P fed from the feeding portion are the same as those of the recording material P fed in the last job. For that reason, in this case, there is a high possibility that the secondary transfer voltage (Vb+Vp+ΔVp) adjusted in the last job is also the proper secondary transfer voltage in the subsequent job (this job). On the other hand, in the case where in the period from the end of the last job until the subsequent job is started, the absence of the recording material P in the feeding portion for feeding the recording materials P in both the jobs is detected, the operator newly places the recording materials P in the feeding portion after the end of the last job. In this case, there is a possibility that the newly placed recording material P is different in drying state from the recording material P used in the last job. This is because the drying state of the recording material (a water content of the recording material) left standing in the feeding portion changes from, for example, the drying state of the recording material P immediately after being taken out of a package depending on an install environment (temperature, humidity) of the image forming apparatus 100 in some instances. When the drying state of the recording material P changes, the proper secondary transfer voltage also changes, and therefore, there is a need to apply the secondary transfer voltage corresponding thereto. Further, there is a possibility that the newly placed recording material P is different in kind from the recording material P used in the last job, so that there is a possibility that the proper secondary transfer voltage changes.

Accordingly, as the predetermined condition relating to the state of the recording material P in S204 of FIG. 11, the following condition can be used. That is, a condition such that in a period from the end of the last job until the subsequent job is started, the absence of the recording material P in the feeding portion for feeding the recording material P in both the jobs is not detected is used. When the signal indicating the absence of the recording material P is inputted from the recording material sensor 42, the controller 50 causes the RAM 52 to store information indicating that the recording material P in the feeding portion is used up (absent). This information is cleared every execution of the job (the recording material sensor 42 is placed in a state in which the absence of the recording material is not detected). On the basis of this information, the controller 50 is capable of discriminating whether or not the absence of the recording material P in the associated feeding portion is detected between the jobs.

Thus, in the case where the absence of the recording material P in the feeding portion is not detected and there is a high possibility that the kind and the drying state of the recording material P in the feeding portion are unchanged, it is possible to succeed the offset voltage ΔVp in the last job. By this, it is possible to perform the application of the proper secondary transfer voltage from the leading end of the first recording material P of the subsequent job, so that the occurrence of the image defect due to the excess and the deficiency of the transfer current at the leading end portion of the recording material P can be suppressed.

7. Effect

As described above, in this embodiment, the image forming apparatus 100 includes the controller 50 for carrying out the constant-voltage control so that the voltage applied to the transfer member 8 becomes the predetermined voltage when the recording material P passes through the transfer portion N2. This controller 50 controls the voltage applied to the transfer member 8, on the basis of a detection result of the current detecting portion 21 so that the detection result of the current detecting portion 21 falls within a predetermined range (limiter control). Then, on the basis of the change amount of the voltage in the limiter control in the first job, the controller 50 determines the predetermined voltage during passing of the first recording material P in the second job through the transfer portion N2 when the first job and the second job subsequent to the first job which are a series of operations, started by a single start instruction, for forming and outputting images on the recording materials P. Here, the image forming apparatus 100 may include the openable feeding portion 11 in which the recording materials P to be supplied to the transfer portion N2 are placed and the open/close detecting portion 41 for detecting the open/close of the feeding portion 11. Further, in the case where the open/close of the feeding portion 11 is detected by the open/close detecting portion 41 in the period from the end of the first job until the second job is started, the controller 50 is capable of not determining the above-described predetermined voltage during the passing of the first recording material P in the second job through the transfer portion N2, on the basis of the change amount. Or, the image forming apparatus 100 may include the plurality of feeding portions where the recording materials P to be supplied to the transfer portion N2 are placed. Further, in the case where the recording materials P are supplied, to the transfer portion N2, from the feeding portions 11 different between the first job and the second job, the controller 50 is capable of not determining the above-described predetermined voltage during the passing of the first recording material P in the second job through the transfer portion N2, on the basis of the change amount.

Further, the image forming apparatus 100 may include the setting portion 31 for setting information on the recording materials P placed on the feeding portion 11. Further, in the case where change in information on the recording materials P placed in the feeding portion 11 is carried out by the setting portion 31 in the period from the end of the first job until the second job is started, the controller 50 is capable of not determining the above-described predetermined voltage during the passing of the first recording material P in the second job through the transfer portion N2, on the basis of the change amount. Further, the image forming apparatus 100 may include the recording material detecting portion 42 for detecting the absence of the recording material P in the feeding portion 11. Further, in the case where the absence of the recording material P is detected by the recording material detecting portion 42 in the period from the end of the first job until the second job is started, the controller 50 is capable of not determining the above-described predetermined voltage during the passing of the first recording material P in the second job through the transfer portion N2, on the basis of the change amount.

As described above, according to this embodiment, it is possible to suppress repetitive occurrence of the image defect, in the subsequent job, similar to the image defect occurred due to the excess and deficiency of the transfer current in the last job.

Incidentally, in this embodiment, in the case where the state of the recording material P does not satisfy the predetermined condition, the offset voltage $\Delta Vp$ was cleared. This is because compared with the recording material P in the last job, the state of the recording material P in the subsequent job is largely changed or is difficult to predict. On the other hand, in the case where the state of the recording material P in the subsequent job changes in comparison with the state of the recording material P in the last job but a change amount thereof can be predicted, a corrected value of the offset voltage $\Delta Vp$ in the last job can be used in the offset voltage $\Delta Vp$ in the subsequent job (this job). By this, it is possible to suppress the occurrence of the image defect due to the excess and deficiency of the transfer current at the leading end portion of the first recording material P in the subsequent job. In this case, when the controller 50 discriminated that the predetermined condition is not satisfied in S204 of FIG. 11, in S205, the controller 50 acquires a corrected offset voltage ($M \times \Delta Vp$) obtained by multiplying the offset voltage $\Delta Vp$ in the last job by a predetermined correction coefficient M (typically $0 \leq M < 1$). Then, in S206, the controller 50 acquires a secondary transfer voltage $Vtr = Vb + Vp + M \times \Delta Vp$ by using this offset voltage. The predetermined correction efficiency M can be appropriately set on the basis of the output $\Delta Vp$ in the last job from the viewpoint that the image defect on the first recording material P in the subsequent job is suppressed.

Further, in this embodiment, the case where the absence of the recording material P in the feeding portion 11 was detected between the jobs was described as an example. For example, in the case where the absence of the recording material P in the feeding portion 11 during a continuous image forming job for continuously forming images on a plurality of recording materials is detected, control may also be carried out in the following manner. That is, the offset voltage set before the recording materials P during the continuous image forming job are used up may also be not succeeded after the recording materials P are used up (at the time of resumption of the continuous image forming job). This is because it is assumed that the state of the recording material P is changed before and after the feeding portion 11 is replenished with the recording materials P.

Embodiment 2

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description (this is true for embodiments described later).

In this embodiment, the image forming apparatus 100 is openable in an adjusting mode in which the operator adjusts a target voltage of the secondary transfer voltage. In this embodiment, in the operation in this adjusting mode, the controller inputs an adjusting value through an adjusting screen 300 displayed at an operating portion 31 as shown in part (a) of FIG. 13, so that the recording material (paper) part voltage Vp can be increased and decreased. This adjusting screen 300 includes an adjusting portion 301 for setting each of adjusting values of secondary transfer voltages for the front surface (side) and the back surface (side) of the recording material P. Further, the adjusting screen 300 includes a determining portion (OK button) 302 for determining setting and a cancel button 303 for canceling a change in setting. In the case where an adjusting value "0" is selected at the adjusting portion 301, the secondary transfer voltage (specifically the recording material part voltage Vp) is set at an operator value (table value). Further, in the case where an adjusting value other than "0" is selected, the secondary transfer voltage (specifically the recording material part voltage Vp) is adjusted with an adjusting amount $\Delta V$ of 150 V every (one) level of the adjusting values. Further, the OK button 302 is operated after the adjusting value is selected, so that setting of the secondary transfer voltage is determined and is stored in the RAM 52.

The controller changes the secondary transfer voltage (specifically the recording material part voltage Vp) every sheet of the recording material P, for example, while outputting an image, intended to be outputted, on a desired recording material P, and determines the adjusting value depending on a result of image observation. The controller 50 causes the RAM 52 to store the selected adjusting value. The controller 50 acquires the adjusting amount $\Delta V = (\text{adjusting value}) \times 150$ V by using the adjusting value stored in the RAM 52 in the operation in the adjusting mode, and calculates a recording material part voltage $Vpa = Vp + \Delta V$ after the adjustment by using the adjusting amount $\Delta V$.

The table data of the recording material part voltage Vp as shown in FIG. 5 is set on the assumption of a normal recording material P in advance. By performing the adjustment of the secondary transfer voltage in the operation in the above-described adjusting mode, the secondary transfer voltage Vp can be optimized depending on the recording material P actually used by the operator. On the other hand, after the adjustment of the secondary transfer voltage is performed by the operation in the adjusting mode, when the setting of the secondary transfer voltage using the offset voltage ΔVp in the last job as described in the embodiment 1 is made, an adjustment result by the operation in the adjusting mode is not reflected, and a result desired by the operator is not obtained in some cases.

Therefore, in this embodiment, in the case where the adjustment of the secondary transfer voltage by the operation in the adjusting mode is performed in the period from the end of the last job until the subsequent job is started, the offset voltage ΔVp in the last job is not succeeded by the subsequent job (this job).

Figure 12:
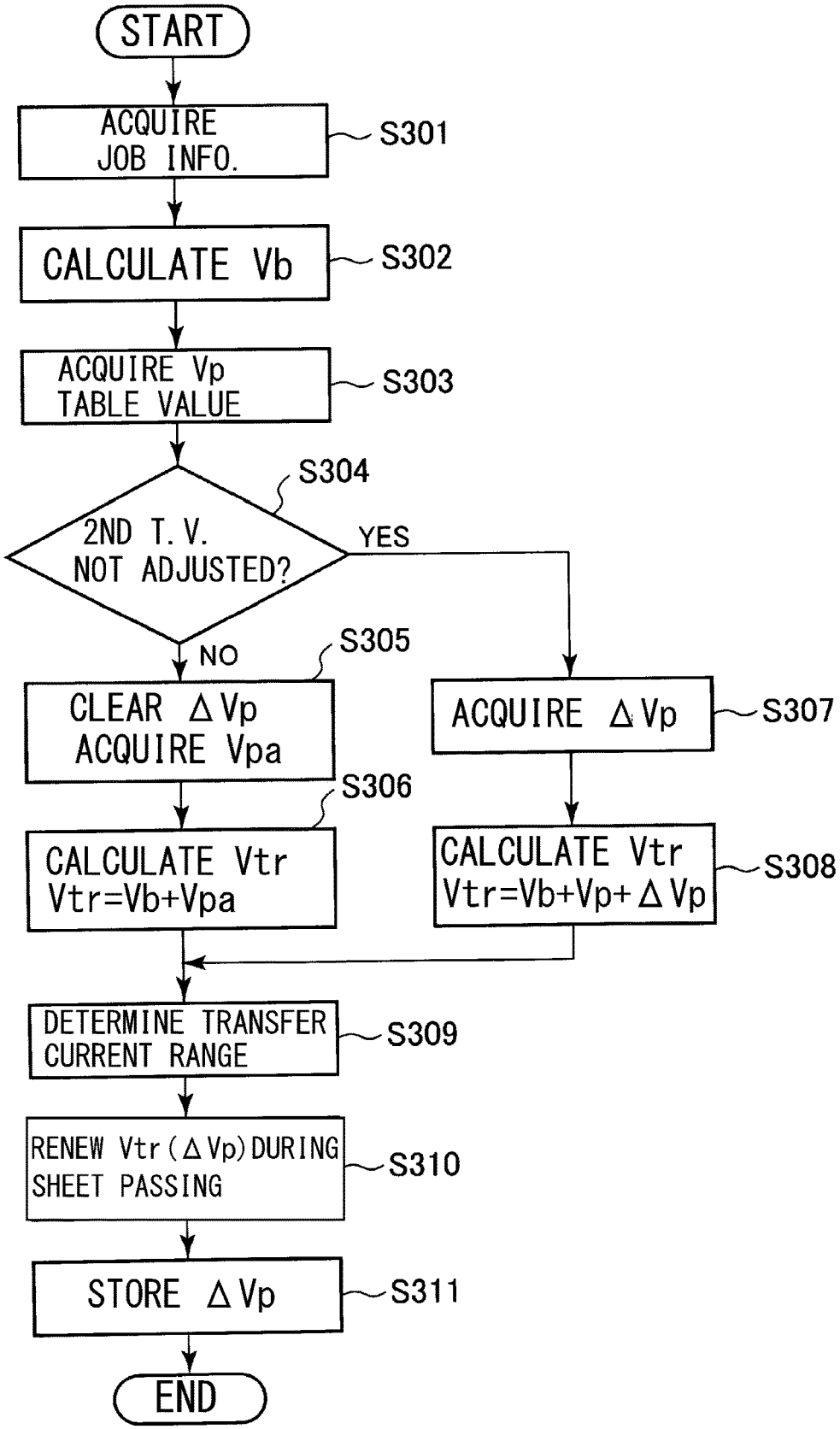
FIG. 12 is a flowchart of secondary transfer voltage control in embodiments 2 to 4.

FIG. 12 is a flowchart showing an outline of a procedure of secondary transfer voltage control in this embodiment using, as the predetermined condition of S104 of FIG. 7, a condition relating to adjustment or non-adjustment of the secondary transfer voltage by the operation in the adjusting mode. FIG. 12 shows, as an example, the case where a job for forming an image on a single recording material P is executed. Description of a procedure similar to the procedure of FIGS. 7 and 11 will be omitted.

Processes of S301 to S303 and S307 to S311 of FIG. 12 are similar to the processes of S101 to S103 and S107 to S111 of FIG. 7, respectively.

The controller 50 discriminates whether or not the adjustment of the secondary transfer voltage by the operation in the adjusting mode is not performed in the period from the end of the last job until this job is started (S304). Incidentally, for example, depending on whether or not the adjusting value other than "0" is stored in the RAM 52, the controller 50 is capable of discriminating whether or not the adjustment of the secondary transfer voltage by the operation in the adjusting mode is performed between the jobs. In the case where the controller 50 discriminated that the adjustment of the secondary transfer voltage by the operation in the adjusting mode is performed in S304, the controller 50 clears the offset voltage ΔVp of the last job stored in the RAM 52 and acquires the recording material part voltage Vpa after the adjustment by the operation in the adjusting mode (S305). Then, the controller 50 acquires, as an initial value of the secondary transfer voltage Vtr in this job, a value of Vb+Vp by adding the base voltage Vb and the recording material part voltage Vp after the adjustment and causes the RAM 52 to store the value of Vb+Vpa (S306). On the other hand, in the case where the controller 50 discriminated that the adjustment of the secondary transfer voltage by the operation in the adjusting mode is not performed in S304, the controller 50 acquires the offset voltage ΔVp of the last job stored in the RAM 52 (S307). Then, the controller 50 acquires, as an initial value of the secondary transfer voltage Vtr in this job, a value of Vb+Vp+ΔVp by adding the base voltage Vb, the recording material part voltage Vp (table value) and the offset voltage ΔVp in the last job and causes the RAM 52 to store the value of Vb+Vp+ΔVp (S308).

Thus, in this embodiment, the image forming apparatus 100 includes the adjusting portion 31 for changing setting of a basis of a predetermined voltage which is a target voltage value of the transfer voltage. Further, in the case where the change in setting of the basis of the predetermined voltage by the adjusting portion 31 is made in the period from the end of the first job until the second job is started, the controller 50 does not determine the predetermined voltage which is the target voltage value of the transfer voltage during passing of the first recording material P in the second job through the transfer portion N2, on the basis of a change amount of the voltage in the limiter control in the first job.

As described above, in this embodiment, in the case where the adjustment of the secondary transfer voltage by the operation in the adjusting mode is performed, the offset voltage ΔVp in the last job is not succeeded, but a secondary transfer voltage adjusted by the operator in the operation in the adjusting mode is used. By this, it is possible to obtain a result desired by the operator. On the other hand, in the case where the adjustment of the secondary transfer voltage by the operation in the adjusting mode is not performed, the offset voltage ΔVp in the last job is succeeded. By this, it is possible to perform the application of a proper secondary transfer voltage from the leading end of the first recording material in the subsequent job, so that the occurrence of the image defect due to the excess and deficiency of the transfer current at the leading end portion of the recording material P can be suppressed.

Embodiment 3

Next, another embodiment of the present invention will be described. This embodiment is a modified embodiment of the embodiment 2, and is different from the embodiment 2 in the operation in the adjusting mode.

In this embodiment, the image forming apparatus 100 is operable in an adjusting mode (simple adjusting mode), as the adjusting mode of the secondary transfer voltage, in which a chart prepared by forming test images of representative colors (hereinafter, these images are also referred to as "patches") while changing the secondary transfer voltage for each of the patches is outputted. In this embodiment, in the operation in this adjusting mode, the operator checks the outputted chart by eye observation or by using a colorimeter and determines a secondary transfer voltage corresponding to the patch providing a preferred result.

Next, the chart (test page) in the operation in the adjusting mode in this embodiment will be described. Parts (a) and (b) of FIG. 14 are schematic views each showing an example of the chart in this embodiment. In this embodiment, charts 500 (500A and 500B) of two kinds shown in parts (a) and (b) of FIG. 14, respectively, are used. The chart 500A of part (a) of FIG. 14 is used for outputting a recording material P of 420 to 487 mm in length with respect to the feeding direction. The chart 500B of part (b) of FIG. 14 is used for outputting a recording material P of 210 to 419 mm in length with respect to the feeding direction.

The chart 500 including a plurality of patch sets each including one solid blue patch 501, one solid black patch 502 and two half-tone patches 502 which are arranged in a direction (referred herein also as a "widthwise direction") substantially perpendicular to the feeding direction. Further, in the chart 500A of part (a) of FIG. 14, 11 patch sets each including the patches 501 to 503 arranged in the widthwise direction are disposed along the feeding direction. Incidentally, the half-tone patch 503 is a gray (half-tone black) patch. Here, the solid image refers to an image with a maximum density level. Further, in this embodiment, the half-tone image refers to an image with a toner application amount of 10% to 80% when the toner application amount of the solid image is 100%. Further, in this embodiment, the chart 500 includes identification information 504 for identifying (discriminating) the setting of the secondary transfer voltage associated with each of the 11 patch sets 501 to 503 with respect to the feeding direction and applied to each of the patch sets. This identification information 504 corresponds to the adjusting value of the secondary transfer voltage. In the chart 500A of part (a) of FIG. 14, 11 pieces (−5 to 0 and 1 to 5 in this embodiment) of the identification information 504 corresponding to settings of the secondary transfer voltage of 11 levels, respectively.

A maximum size of the recording material P usable in the image forming apparatus 100 of this embodiment is 13 inch (330 mm in widthwise direction)×19.2 inch (≈487 mm in feeding direction), and the chart 500A of part (a) of FIG. 14 meets this size. In the case where the size of the recording material P is 13 inch×19.2 inch (short edge feeding) or less and is an A3-size (short edge feeding) or more, a chart corresponding to image data extracted from data of the shown chart depending on the size of the recording material P is outputted. At this time, in this embodiment, the image data is extracted correspondingly to the size of the recording material P on a leading end center basis. That is, the image data is extracted in a state in which the leading end of the recording material P with respect to the feeding direction and the leading end (upper end in the figure) of the hang 500A with respect to the feeding direction are aligned with each other and in a state in which a center (line) of the recording material P with respect to the widthwise direction and a center (line) of the chart 500A with respect to the widthwise direction are aligned with each other. Further, in this embodiment, the image data is extracted so as to leave a margin of 2.5 mm at each of end portions (both end portions with respect to the widthwise direction and both end portions with respect to the feeding direction in this embodiment). For example, in the case where an adjusting chart 500A is outputted on an A3-sized recording material P (short edge feeding), an image data of a size of 292 mm (short side)×415 mm (long side) is extracted so as to leave the margin of 2.5 mm at each end portion. Then, an image corresponding to this extracted image data is outputted on the A3-sized recording material P on the leading end center basis. In the case where a recording material P with a size smaller than 13 inch with respect to the widthwise direction is used, the widthwise sizes of the half-tone patches 503 provided at the end portions with respect to the widthwise direction are decreased. Further, in the case where the recording material P with the size smaller than 13 inch with respect to the widthwise direction is used, a trailing end margin of the recording material P with respect to the feeding direction is decreased. The 11 patch sets each including the patches 501 to 503 are disposed in a range of 387 mm in length with respect to the feeding direction so as to fall within a length of 415 mm with respect to the feeding direction in the case where the size of the recording material P is the A3 size. Further, in this embodiment, the chart can be outputted by using not only a regular-size recording material P but also an arbitrary-size (free-size) recording material P by inputting and designating the size of the recording material P through the operating portion 31 or from the external device 200 by the operator, for example.

In this embodiment, in the case where the recording material P smaller than the A3 size is used, the chart 500B of part (b) of FIG. 14 is used. The chart 500B of part (b) of FIG. 14 meets sizes (210 to 419 mm) ranging from an A4 size (short edge feeding) to a size smaller than the A3 size. An image size of the chart 500B is 13 inch (widthwise direction)×210 mm (feeding direction). With respect to the widthwise direction, the half-tone patches 503 are decreased in length correspondingly to the size of the recording material P. With respect to the feeding direction, 5 patch sets are formed so as to fall within a length of 167 mm, and the trailing end margin is increased correspondingly to the sizes of the recording material P from 210 mm to 419 mm. In the case where the sizes of the recording materials P are 210 mm to 419 mm in length, only the 5 patch sets can be outputted on a single sheet. For this reason, in this case, in order to increase the number of patches (patch sets), two charts 500B are outputted on two recording materials P by using secondary transfer voltages corresponding to adjusting values −4 to 0 and 1 to 5.

A patch size is required to be a size for which occurrence and non-occurrence of the image defect are easily discriminated by the operator. As regards a transfer property of the solid blue patches 501 and the solid black patches 502, when the patch size is small, discrimination is liable to become difficult, so that the pitch size may preferably be 10 mm square or more, more preferably be 25 mm square or more. The image defect due to abnormal electric discharge occurring in the half-tone patches 503 in the case where the secondary transfer voltage is increased is an image defect such as white dots (voids) in many instances. This image defect has a tendency that compared with the transfer property of the solid images, the image defect is easily discriminated even when the image is a small image. However, the image is easy to see when the image is not excessively small, and therefore in this embodiment, the width of each of the half-tone patches 503 with respect to the feeding direction is made equal to the width of each of the solid blue patches 501 and the solid black patches 502. Further, an interval between adjacent patch sets 501 to 503 with respect to the feeding direction may be set so as to enable switching of the secondary transfer voltage. In this embodiment, each of the solid blue patches 501 and the solid black patches 502 is a square of 25.7 mm×25.7 mm (one side thereof is substantially parallel to the feeding direction). Further, in this embodiment, each of the half-tone patches 503 disposed at both end portions with respect to the widthwise direction is 25.7 mm in width with respect to the feeding direction, and extends to a right (or left)-hand end of the adjusting chart 500 in the widthwise direction. Further, in this embodiment, an interval between adjacent patch sets 501 to 503 is 9.5 mm. The secondary transfer voltage is switched at timing when a portion on the chart 500 corresponding to this interval passes through the secondary transfer portion N2.

Incidentally, in the neighborhood of the leading end and the trailing end of the recording material P with respect to the feeding direction (for example, in a range of about 20-30 mm from the edge), it is preferable that the patch is not formed. This is for the following reason. That is, of the end portions of the recording material P with respect to the feeding direction, there is an image defect occurring only at the leading end or the trailing end without occurring in the end portions with respect to the widthwise direction in some instances. In this case, due to a change in secondary transfer voltage, whether or not the image defect occurs is not readily discriminated in some instances.

Part (b) of FIG. 13 is a schematic view showing an example of an adjusting screen 400 displayed on the operating portion 31 in the operation in the adjusting mode in this embodiment. This adjusting screen 400 includes an adjusting portion 401 for setting each of adjusting values of secondary transfer voltages for the front surface (side) and the back surface (side) of the recording material P. Further, this adjusting screen 400 includes an output surface selecting portion 402 for selecting output of the chart 500 on one surface of the recording material P or output of the chart 500 on both surfaces. Further, the adjusting screen 400 includes an output instruction portion (chart print button) 403 for providing an instruction to output the chart 500. Further, the adjusting screen 400 includes a determining portion (OK button) 404 for determining setting and a cancel button 405 for canceling a change in setting. In the case where an adjusting value "0" is selected at the adjusting portion 401, the secondary transfer voltage (specifically the recording material part voltage Vp) is set at an operator value (table value), and a center voltage value of the secondary transfer voltage during the output of the chart 500 is set at a voltage thereof. Further, in the case where an adjusting value other than "0" is selected, the secondary transfer voltage is adjusted with an adjusting amount ΔV of 150 V every (one) level of the adjusting values, and a center voltage value of the secondary transfer voltage during the output of the chart 500 is set at a voltage thereof. After the adjusting value is selected, the chart print button 403 is operated, whereby the chart 500 is outputted with the selected center voltage value. Further, the OK button 404 is operated after the adjusting value is selected, so that setting of the secondary transfer voltage is determined and is stored in the RAM 52.

FIG. 15 is a flowchart showing an outline of a procedure of the operation in the adjusting mode in this embodiment. First, by the operator, the cassette 11 in which the recording materials P used for adjustment are accommodated is selected, and the kind and the size of the recording materials P are selected, and then pieces of information thereon are inputted into the controller 50 (S401). Then, by the operator, on the adjusting screen 400 displayed on the operating portion 31 as shown in part (b) of FIG. 13, the center voltage value during the output of the chart 500, and the output of the chart 500 on one surface of the recording material P or the output of the chart 500 on both surfaces of the recording material P are set, and then pieces of information thereon are inputted (S402). In the case where the adjusting value "0" is selected, a predetermined secondary transfer voltage (reference value) set in advance for the kind of the recording material P is selected. For example, in the case of the chart 500 of part (a) of FIG. 14, when the adjusting value "0" is selected, the secondary transfer voltages corresponding to the adjusting values "−5" to "0" and "(+)1" to "(+)5" are used, so that the chart 500 is outputted. In this embodiment, a level of the adjusting value of 1 corresponds to the adjusting value ΔV=150 V of the secondary transfer voltage (specifically the recording material part voltage Vp). When the chart print button 403 is operated in the adjusting screen 400 by the operator, the controller 50 causes the image forming apparatus to output the chart 500 (test page) while changing the secondary transfer voltage every 150 V for each of the patch sets with respect to the feeding direction (S403). For example, in the case where the recording material part voltage Vp based on the kind of the selected recording material P and the detection result of the environmental sensor 32 is 2500 V and the base voltage Vb necessary to cause the target current Itarget to flow is 1000 V, the chart 500 is outputted in the following manner. That is, the chart 500 is outputted while changing the secondary transfer voltage every 150 V from 2750 V to 4250 V. Then, the operator watches the patches of the outputted state and determines an optimum adjusting value (S404). In the case where the secondary transfer voltage is increased from a low value, it is possible to determine a lower limit of the secondary transfer voltage from voltage values capable of properly transferring the patch of the secondary color such as blue. Further, in the case where the secondary transfer voltage is further increased, it is possible to determine an upper limit of the secondary transfer voltage from voltage values at which the image defect due to a high secondary transfer voltage occurs on the solid black patch and the half-tone patch. Then, the operator is capable of setting the secondary transfer voltage in a range between the upper limit and the lower limit. In the case where there is no optimum adjusting value, the sequence returns to S402, and the operator changes the center voltage value and then causes the image forming apparatus to output the chart 500 again (S405). When the operator determines the optimum secondary transfer voltage, the operator inputs the adjusting value in the adjusting screen. When the adjusting value is inputted and determined in the adjusting screen by the operator, information thereon is inputted into the controller 50, and the controller 50 causes the RAM 52 to store the information (S406). The controller 50 acquires the adjusting amount ΔV=(adjusting value)×150 V by using the adjusting value stored in the RAM 52 in the operation in the adjusting mode, and calculates a recording material part voltage Vpa=Vp+ΔV after the adjustment by using the adjusting amount ΔV.

In this embodiment, similarly as in the embodiment 2, the secondary transfer voltage control is carried out by the procedure shown in FIG. 12. That is, the controller 50 discriminates, in S304 of FIG. 12, whether or not the secondary transfer voltage is not adjusted by the operation in the adjusting mode in this embodiment. Further, in the case where the controller 50 discriminated that the adjustment of the secondary transfer voltage by the operation in the adjusting mode is performed in S304, the controller 50 clears the offset voltage ΔVp of the last job stored in the RAM 52 and acquires the recording material part voltage Vpa after the adjustment by the operation in the adjusting mode (S305). Then, the controller 50 acquires, as an initial value of the secondary transfer voltage Vtr in this job, a value of Vb+Vp by adding the base voltage Vb and the recording material part voltage Vp after the adjustment and causes the RAM 52 to store the value of Vb+Vpa (S306).

As described above, also by this embodiment, an effect similar to the effect of the embodiment 2 can be achieved. Further, in the operation in the adjusting mode in this embodiment, the optimum secondary transfer voltage can be set by using the chart including the patches formed on the single recording material P with the plurality of secondary transfer voltages, so that adjustment of the secondary transfer voltage can be simplified more than the embodiment 2.

Embodiment 4

Next, another embodiment of the present invention will be described. This embodiment is a modified embodiment of the embodiments 2 and 3, and is different from the embodiments 2 and 3 in the operation in the adjusting mode.

In the operation in the adjusting mode in the embodiment 3, the operator checked the outputted chart by eye observation or by using a colorimeter and determined the adjusting value. On the other hand, in the operation in the adjusting mode in this embodiment, a chart is read by the image reading portion 90, and an adjusting value is determined in the controller 50.

The chart outputted in the operation in the adjusting mode in this embodiment is the same as the chart in the embodiment 3 shown in parts (a) and (b) of FIG. 14. Further, an adjusting screen displayed on the operating portion 31 in the operation in the adjusting mode in this embodiment is the same as the adjusting screen in the embodiment 3.

FIG. 16 is a flowchart showing an outline of a procedure of the operation in the adjusting mode in this embodiment. First, by the operator, the cassette 11 in which the recording materials P used for adjustment are accommodated is selected, and the kind and the size of the recording materials P are selected, and then pieces of information thereon are inputted into the controller 50 (S501). Then, by the operator, on the adjusting screen 400 displayed on the operating portion 31 as shown in part (b) of FIG. 13, the center voltage value during the output of the chart 500, and the output of the chart 500 on one surface of the recording material P or the output of the chart 500 on both surfaces of the recording material P are set, and then pieces of information thereon are inputted (S502). When the chart print button 403 is operated in the adjusting screen 400 by the operator, the controller 50 causes the image forming apparatus to output the chart 500 (test page) while changing the secondary transfer voltage every 150 V for each of the patch sets with respect to the feeding direction (S503). Then, the outputted chart 500 is set on the image reading portion 90 by the operator and is read by the image reading portion, and then information on the chart including brightness information (density information) of each of the patches is inputted into the controller 50 (S504). Then, the controller 50 acquires RGB brightness data (8 bit) of each of the solid blue patches of the chart 500 and acquires an average of values of the brightness of the respective solid blue patches (S505). In S505, as an example, information indicating a relationship between a level of the secondary transfer voltage adjusting value corresponding to the associated patch and the average of the brightness values of the respective patches is acquired as shown in FIG. 17. For the solid blue patch, the B brightness data is used. Then, the controller 50 determines a candidate for the secondary transfer voltage adjusting value on the basis of the information on the average of the brightness values acquired in S505 (S506). For example, an adjusting value at which the brightness average is minimum (i.e., density is maximum) is determined as the candidate for the secondary transfer voltage adjusting value. Then, the controller 50 causes the adjusting portion 401 of the adjusting screen 400 as shown in part (b) of FIG. 13 to display the candidate of the secondary transfer voltage adjusting value determined in S506. Here, on the basis of display contents of the adjusting screen 400 and the outputted chart 500, the operator is capable of discriminating whether or not the adjusting value may be the adjusting value displayed on the adjusting screen 400 (S508). In the case where the operator changes the adjusting value displayed on the adjusting screen 400, by the operator, the adjusting value is inputted at the adjusting screen 400 and the OK button 404 is operated, and then the controller 50 causes the RAM 52 to store the inputted adjusting value (S510). In the case where the operator does not change the adjusting value displayed on the adjusting screen 400, the OK button 404 is operated on the adjusting screen 400 by the operator, so that the controller 50 causes the RAM 52 to store the adjusting value determined in S507 (S509). The controller 50 acquires the adjusting amount $\Delta V$=(adjusting value)×150 V by using the adjusting value stored in the RAM 52 in the operation in the adjusting mode, and calculates a recording material part voltage $Vpa=Vp+\Delta V$ after the adjustment by using the adjusting amount $\Delta V$.

Incidentally, in this embodiment, the solid blue patches were used for acquiring the brightness data, but the present invention is not limited thereto, and instead of the solid blue patches, patches of solid red or solid green, which are a secondary color may be used or patches of a solid single color of YMCK may also be used. Further, as the brightness data, data of RGB or the like may also be used. Further, instead of the reading of the chart by the image reading portion 90, the chart may also be read by an in-line image sensor when the chart is outputted from the image forming apparatus 100. For example, the in-line image sensor is provided on a side downstream of the fixing device 10 with respect to the feeding direction of the recording material P and when the chart is outputted from the image forming apparatus 100, brightness information (density information) of the patch on the chart can be read by the image sensor.

In this embodiment, similarly as in the embodiments 2 and 3, the secondary transfer voltage control is carried out by the procedure shown in FIG. 12. That is, the controller 50 discriminates, in S304 of FIG. 12, whether or not the secondary transfer voltage is not adjusted by the operation in the adjusting mode in this embodiment. Further, in the case where the controller 50 discriminated that the adjustment of the secondary transfer voltage by the operation in the adjusting mode is performed in S304, the controller 50 clears the offset voltage $\Delta Vp$ of the last job stored in the RAM 52 and acquires the recording material part voltage Vpa after the adjustment by the operation in the adjusting mode (S305). Then, the controller 50 acquires, as an initial value of the secondary transfer voltage Vtr in this job, a value of Vb+Vp by adding the base voltage Vb and the recording material part voltage Vp after the adjustment and causes the RAM 52 to store the value of Vb+Vpa (S306).

As described above, also by this embodiment, an effect similar to the effect of the embodiments 2 and 3 can be achieved. Further, in the operation in the adjusting mode in this embodiment, the secondary transfer voltage adjusting value can be determined by the controller 50 on the basis of the information of the chart read by the image reading portion 90, so that adjustment of the secondary transfer voltage can be further simplified more than the embodiments 2 and 3.

Embodiment 5

Next, another embodiment of the present invention will be described. As described in the embodiment 1, in the case where the jobs are executed intermittently as in the example shown in FIG. 10, there is little change in environment and there is also little change in drying state of the recording material P. For that reason, the offset voltage $\Delta Vp$ in the last job is succeeded and then the secondary transfer voltage Vtr in the subsequent job is set, so that the image defect is suppressed and a proper image can be outputted in the subsequent job. However, in the case where a time from the end of the last job until the subsequent job is started is long, the drying state of the recording material P changes, so that there is a possibility that the electric resistance of the recording material P changes. This is because an ambient humidity changes due to a change in weather, the presence or absence of air conditioning, or the like. Although the electric resistance of the recording material P changed, when the offset voltage $\Delta Vp$ in the last job is succeeded and the secondary transfer voltage Vtr is set, there is a possibility that the secondary transfer current is out of a proper range and the image defect occurs.

A phenomenon such that the secondary transfer current falls below the lower limit of the predetermined current range is liable to occur in the case where the recording material P is dried in a low humidity environment. In the case where the secondary transfer current falls below the lower limit of the predetermined current range in the last job and the secondary transfer voltage is adjusted, when the environment is the low humidity environment also during execution of the subsequent job, there is a high possibility that the drying state of the recording material P is close to the drying state of the recording material P during execution of the last job. For that reason, in this case, by succeeding the offset voltage ΔVp in the last job, it is possible to suppress the occurrence of the image defect at the leading end portion of the first recording material P in the subsequent job. On the other hand, in the case where the environment is a normal humidity environment or a high humidity environment, there is a high possibility that the drying state of the recording material P changes from the drying state of the recording material P during the execution of the last job. For that reason, in this case, it is preferable that the output ΔVp in the last job is not succeeded.

On the other hand, a phenomenon such that the secondary transfer current falls above the upper limit of the predetermined current range is liable to occur in the case where the recording material P takes up moisture in the high humidity environment. In the case where the secondary transfer current falls above the upper limit of the predetermined current range in the last job and the secondary transfer voltage is adjusted, when the environment is the high humidity environment also during execution of the subsequent job, there is a high possibility that the drying state of the recording material P is close to the drying state of the recording material P during execution of the last job. For that reason, in this case, by succeeding the offset voltage ΔVp in the last job, it is possible to suppress the occurrence of the image defect at the leading end portion of the first recording material P in the subsequent job. On the other hand, in the case where the environment is the normal humidity environment or the high humidity environment, there is a high possibility that the drying state of the recording material P changes from the drying state of the recording material P during the execution of the last job. For that reason, in this case, it is preferable that the output ΔVp in the last job is not succeeded.

FIG. 18 is a flowchart showing an outline of a procedure of secondary transfer voltage control in this embodiment using, as the predetermined condition of S104 of FIG. 7, a condition relating to the environment as described above. FIG. 18 shows, as an example, the case where a job for forming an image on a single recording material P is executed. Description of a procedure similar to the procedure of FIGS. 7 and 11 will be omitted.

Processes of S601 to S603 of FIG. 18 are similar to the processes of S101 to S103 of FIG. 7, respectively. Further, processes of S606 and S607 of FIG. 18 are similar to the processes of S105 and S106 of FIG. 7, respectively. Further, the processes of S609 and S610, and S612 and S613 of FIG. 18 are similar to the processes of S107 and S108 of FIG. 7, respectively. Further, processes of S614 to S616 of FIG. 18 are the processes of S109 and S111 of FIG. 7, respectively.

The controller 50 acquires the last job information stored in the RAM 52 (S604). This information includes, as the information relating to the environment during the execution of the last job, information on whether or not the secondary transfer current is out of the predetermined current range (i.e., falls below the lower limit or falls above the upper limit) in the last job. On the basis of the last job information acquired in S604, the controller 50 discriminates whether the secondary transfer current falls below the lower limit or fall above the upper limit of the predetermined current range in the last job (S605).

In the case where the controller 50 discriminated that the secondary transfer current is not out of the predetermined current range (i.e., falls within the predetermined current range) in the last job in S605, the controller 50 clears the offset voltage ΔVp of the last job stored in the RAM 52 (S606). Then, the controller 50 acquires, as an initial value of the secondary transfer voltage Vtr in this job, a value of Vb+Vp by adding the base voltage Vb and the recording material part voltage Vp (table value) and causes the RAM 52 to store the value of Vb+Vp (S607).

In the case where the controller 50 discriminated that the secondary transfer current falls below the predetermined current range in the last job in S605, the controller 50 discriminates whether or not the environment during execution of this job acquired on the basis of the detection result of the environmental sensor 32 is the low humidity environment (S608). This is because, in this case, there is a high possibility that the environment during the execution of the last job was the low humidity environment in which the recording material P is dried. Then, in the case where the controller 50 discriminated that the environment is not the low humidity environment (i.e., is the normal humidity environment or the high humidity environment) in S608, the sequence goes to the processes of S606 and S607, and the output ΔVp in the last job is not succeeded. On the other hand, in the case where the controller 50 discriminated that the environment is the low humidity environment in S608, the controller 50 acquires the offset voltage ΔVp of the last job stored in the RAM 52 (S609). Then, the controller 50 acquires, as an initial value of the secondary transfer voltage Vtr in this job, a value of Vb+Vp+ΔVp by adding the base voltage Vb, the recording material part voltage Vp (table value) and the offset voltage ΔVp in the last job and causes the RAM 52 to store the value of Vb+Vp+ΔVp (S610).

Further, in the case where the controller 50 discriminated that the secondary transfer current falls above the predetermined current range in the last job in S605, the controller 50 discriminates whether or not the environment during the execution of this job acquired on the basis of the detection result of the environmental sensor 32 is the high humidity environment (S611). This is because, in this case, there is a high possibility that the environment during the execution of the last job is the high humidity environment in which the recording material P takes up moisture. Then, in the case where the controller 50 discriminated that the environment is not the high humidity environment (i.e., is the normal humidity embodiment or the high humidity environment S611, the sequence goes to the process of S606 and S607, and the offset voltage ΔVp in the last job is not succeeded. On the other hand, in the case where the controller 50 discriminated that the environment is the high humidity environment in S611, the controller 50 acquires the offset voltage ΔVp in the last job stored in the RAM 52 (S612). Then, the controller 50 acquires, as an initial value of the secondary transfer voltage Vtr in this job, a value of Vb+Vp+ΔVp which is the sum of the base voltage Vb, the recording material part voltage Vp (table value) and the offset voltage ΔVp in the last job and causes the RAM 52 to store the value of Vb+Vp+ΔVp (S613).

Thus, in this embodiment, the image forming apparatus 100 includes the environment detecting means 32. Further, in the case where the voltage is changed by the limiter control in the first job so that an absolute value thereof is increased and in the case where an absolute water content shown in the detection result of the environment detecting means 32 when the second job is executed is less than a predetermined threshold, the controller 50 determines the predetermined voltage which is the target voltage value of the transfer voltage during passing of the first recording material P in the second job through the transfer portion N2, on the basis of a change amount of the voltage in the limiter control in the first job. Similarly, in the case where the voltage is changed by the limiter control in the first job so that the absolute value thereof is decreased and in the case where the absolute water content shown in the detection result of the environment detecting means 32 when the second job is executed is not less than the predetermined threshold, the controller 50 determines the predetermined voltage which is the target voltage value of the transfer voltage during passing of the first recording material P in the second job through the transfer portion N2, on the basis of the change amount of the voltage in the limiter control in the first job.

As described above, the state of the recording material P is discriminated from the change in environment, so that it is possible to perform the application of a proper secondary transfer voltage from the leading end of the first recording material in the subsequent job, and thus the occurrence of the image defect due to the excess and deficiency of the transfer current at the leading end portion of the recording material P can be suppressed.

Incidentally, in this embodiment, as the information relating to the environment during the execution of the last job, the information on whether or not the secondary transfer current is out of the predetermined current range was used, but the detection result of the environmental sensor 32 during the execution of the last job is stored and may also be used. In this case, in S605 of FIG. 18, the controller 50 discriminates whether the environment during the execution of the last job was the normal humidity embodiment, the low humidity environment or the high humidity environment. Then, the sequence may go to S606 in the case where the controller 50 discriminated that the environment was the normal humidity environment, S608 in the case where the controller 50 discriminated that the environment was the low humidity environment, and S611 in the case where the controller 50 discriminated that the environment was the high humidity environment.

Further, in the case where the time from the end of the last job until this job is started is sufficiently short, there is little change in the period. Accordingly, as the predetermined condition of S104 of FIG. 7, it is possible to use a condition such that whether before a lapse of a predetermined time from the end of the last job, the subsequent job (this job) is started. Then, in the case where the subsequent job is started before the lapse of the predetermined time, the offset voltage ΔVp in the last job can be succeeded. On the other hand, the subsequent job is started after the lapse of the predetermined time after the last continuous image forming job is ended, the offset voltage ΔVp in the last job in capable of being not succeeded. The predetermined time can be appropriately set from the viewpoint that the output ΔVp in the last job is succeeded and the image defect on the first recording material P in the subsequent job is suppressed. As the predetermined time, it is possible to cite within about 10 minutes, for example 1 minute to 5 minutes.

Thus, when the environment is divided as to an absolute water content indicated by the detection result of the environment detecting means 32, in the case where the environment during execution of the first job and the environment during execution of the second job are different from each other in section, the predetermined voltage which is the target voltage for the transfer voltage during passing of the first recording material P in the second job through the transfer portion N2 is capable of being not determined by the controller 50 on the basis of the change amount of the voltage in the limiter control in the first job. Further, in the case where the second job is started after the lapse of the predetermined time after the first job is ended, the predetermined voltage which is the target voltage for the transfer voltage during passing of the first recording material P in the second job through the transfer portion N2 is capable of being not determined by the controller 50 on the basis of the change amount of the voltage in the limiter control in the first job.

Embodiment 6

Next, another embodiment of the present invention will be described. In the embodiment 5, in the case where the secondary transfer current falls below the lower limit in the last job, when the environment during execution of the subsequent job is not the low humidity environment, the offset voltage ΔVp in the last job was cleared. However, the environment has already been not the low humidity environment during execution of the last job, but the recording material P is still in the drying state in some instances. In this case, depending on a time after the environment is not the low humidity environment, the change in electric resistance due to the change in drying state of the recording material P is small, so that the change in proper recording material part voltage Vp+ΔVp is small. For that reason, in this case, the offset voltage ΔVp in the last job can be used by being corrected.

Similarly, in the embodiment 5, in the case where the secondary transfer current falls above the upper limit in the last job, when the environment during the execution of the subsequent job is not the high humidity environment, the offset voltage ΔVp in the last job was cleared. However, the environment has already been not the high humidity environment during execution of the last job, but the recording material P is still in the moisture absorption state in some instances. In this case, depending on a time after the environment is not the high humidity environment, the change in electric resistance due to the change in drying state of the recording material P is small, so that the change in proper recording material part voltage Vp+ΔVp is small. For that reason, in this case, the offset voltage ΔVp in the last job can be used by being corrected.

FIG. 19 is a graph showing an example of a change in water content of the recording material P in the case where the environment changes from the low humidity environment to the normal humidity embodiment and in the case where the environment changes from the low humidity environment to the high humidity environment. As shown in FIG. 19, in the case where the environment changed, the water content of the recording material P gradually changes and becomes a water content corresponding to an ambient humidity. In the example of FIG. 19, in about 1 hour, the water content reaches the water content corresponding to the environment (ambient humidity) and thus in a substantially equilibrium state. However, when the elapsed time is within 30 minutes, the water content of the recording material P is during the change, so that as described above, the secondary transfer voltage in the subsequent job can be set by using the corrected offset voltage ΔVp in the last job. In this case, an initial value of the secondary transfer voltage Vtr in the subsequent job can be acquired by the following formula 1. In the following formula 1, Vp' represents the recording material part voltage (Vp+ΔVp) after being corrected by the limiter control in the last job. That is, in the following formula 1, (Vp'−Vp) corresponds to the offset voltage ΔVp.

$$Vtr=(Vb+Vp)+(Vp'-Vp)\times A \quad \text{formula 1}$$

In this embodiment, a value of a coefficient A in the formula 1 is changed depending on the change in environment and the elapsed time as shown in a table 1 appearing hereinafter. Not only in the case where the environment changes from the low humidity environment to the normal humidity embodiment but also in the case where the environment changes from the high humidity environment to the normal humidity embodiment, the coefficient A may be set similarly in accordance with the table 1. Incidentally, information on the coefficient A in the table 1 is set in advance and is stored in the ROM 53. Then, the controller 50 makes reference to this information when the controller 50 acquires the secondary transfer voltage in the subsequent job. That is, in the case where the environment is discriminated in S608 of FIG. 18 that the environment is not the low humidity environment, the coefficient A relating to the change from the low humidity environment to the normal humidity embodiment in the table 1 is selected depending on the time from the end of the last job until this job is started. Further, instead of the processes of S606 and S607 of FIG. 18, the secondary transfer voltage is acquired in accordance with the above-described formula 1, and is stored in the RAM 52. Further, in the case where the environment is discriminated in S611 of FIG. 18 that the environment is not the high humidity environment, the coefficient A relating to the change from the high humidity environment to the normal humidity embodiment in the table 1 is selected depending on the time from the end of the last job until this job is started. Further, instead of the processes S606 and S607 of FIG. 18, the secondary transfer voltage is acquired in accordance with the above-described formula 1, and is stored in the RAM 52.

TABLE 1

| | (Coefficient) | | |
|---|---|---|---|
| Elapsed time (min) | T ≤ 10 | 10 < T ≤ 20 | 20 < T ≤ 30 |
| LHE to NHE*1 | 9/10 | 8/10 | 7/10 |
| HHE to NHE*2 | 11/10 | 12/10 | 13/10 |

*1"LHE to NHE" is the change from the low humidity environment to the normal humidity embodiment.
*2"HHE to NHE" is the change from the high humidity environment to the normal humidity embodiment.

In the case where the environment changes form the low humidity environment to the normal humidity embodiment, the electric resistance of the recording material P gradually lowers, so that a value of the coefficient A is made smaller with a longer time from the end of the last job. In this case, the coefficient A is less than 1. On the other hand, in the case where the environment changes from the high humidity environment to the normal humidity embodiment, the electric resistance of the recording material P gradually increases, so that the value of the coefficient A is made larger with a longer time from the end of the last job. In this case, the coefficient A is 1 or more.

For example, it is assumed that (Vb+Vp) is 2500 V, (Vb+Vp') is 3200 V and the (elapsed) time from the end of the last job is within 10 minutes. In this case, the coefficient A in the formula 1 is 9/10, so that from 2500+(3200−2500)×9/10=3130, the secondary transfer voltage Vtr in the state is not 3200 V in the case where the offset voltage ΔVp is succeeded as it is, but is 3130 V.

That is, even in the case where the environment is changed between during the execution of the last job and during the execution of this job, the offset voltage ΔVp in the last job is not cleared, but can be used after being corrected. In this embodiment, the offset voltage (A×offset voltage ΔVp) after being corrected by multiplying the offset voltage ΔVp by a predetermined correction coefficient A (0≤A<1 or A≥1). By this, it is possible to acquire the secondary transfer voltage Vtr=Vb+Vp+A×ΔVp after the correction.

Incidentally, in this embodiment, in the case where the environment abruptly changes from the low humidity environment to the high humidity environment, the water content of the recording material P abruptly changes, and therefore, the correction is not made. This is because in this case, setting of the secondary transfer voltage depending on the environment may preferably be made again.

Thus, in this embodiment, the controller 50 changes the voltage so as to increase an absolute value thereof by the limiter control in the first job, and in the case where the absolute water content indicated by the detection result of the environment detecting means 32 is a predetermined threshold or more and in the case where the second job is started before a lapse of a predetermined time after the first job is ended, the predetermined voltage which is the target voltage for the transfer voltage when the first recording material P in the second job passes through the transfer portion N2 can be changed to a value obtained by adding a value, obtained by multiplying the change amount of the voltage in the limiter control in the first job by a predetermined first coefficient, to a reference value corresponding to the second job. Typically, the first coefficient is 0 or more and less than 1.

Similarly, the controller 50 changes the voltage so as to decrease an absolute value thereof by the limiter control in the first job, and in the case where the absolute water content indicated by the detection result of the environment detecting means 32 is less than the predetermined threshold and in the case where the second job is started before a lapse of a predetermined time after the first job is ended, the predetermined voltage which is the target value for the transfer voltage when the first recording material P in the second job passes through the transfer portion N2 can be changed to a value obtained by adding a value, obtained by multiplying the change amount of the voltage in the limiter control in the first job by a predetermined second coefficient, to a reference value corresponding to the second job. Typically, the second coefficient is 1 or more.

As described above, according to this embodiment, in the case where the subsequent job is started before a lapse of a predetermined time (30 minutes in this embodiment) after the last job is ended, the secondary transfer voltage in the second job can be set on the basis of the offset voltage ΔVp in the last job. By this, even in the case where the environment changes to some extent between during the execution of the last job and during the execution of this job, it is possible to perform application of the proper secondary transfer voltage from the leading end of the first recording material P in the subsequent job. As a result, it is possible to suppress the occurrence of the image defect due to the excess and deficiency of the transfer current at the leading end portion of the recording material P.

Embodiment 7

Next, another embodiment of the present invention will be described. In this embodiment, an example in which the last job is a continuous image forming job will be described.

In the low humidity environment, as regards a bundle (paper bundle) of the recording materials P accommodated in the cassette 11, the water content is largely different between the uppermost recording material P and the recording material P positioned at a center of the bundle. The water content gradually increased from the uppermost recording material P to the center recording material P, and the water content of the center recording material P is close to the recording material water content when the recording materials P are taken out of the package. For that reason, in the case where the last job is the continuous image forming job, as regards the uppermost recording material P, the secondary transfer current falls below the lower limit of a predetermined current range, and the secondary transfer voltage is changed from (Vb+Vp) to (Vb+Vp'). However, as regards the recording material P close to the center of the recording material bundle, Vp' is a value close to Vp, so that a possibility that the secondary transfer current falls below the lower limit of the predetermined current range becomes low.

Then, Vp' suitable for the first recording material P in the subsequent job is different depending on whether the state of the recording material P is close to the state of the first recording material in the last continuous image forming job or the state of the recording material P near the center of bundle. That is, for example, immediately after the last continuous image forming job, the state of the first recording material P in the subsequent job is close to the state of the recording material P near the center of the bundle in the last job. However, when a time has elapsed after the last continuous image forming job is ended, the recording materials P in the cassette 11 and dried again, so that the state of the first recording material P in the subsequent job is close to the state of the first recording material P in the last continuous image forming job.

In consideration thereof, in this embodiment, in this embodiment, in the case where the subsequent job is started after a lapse of a predetermined time or more after the end of the last continuous image forming job, the secondary transfer voltage is set in the following manner. That is, the secondary transfer voltage in the subsequent job is set by using Vp' (or the offset voltage ΔVp) of the first recording material P in the last job. On the other hand, in the case where the subsequent job is started before the lapse of the predetermined time, the secondary transfer voltage in the subsequent job is set by using Vp' of the recording material P after the first recording material P in the last job. Whether or not Vp' of what recording material P is used can be changed depending on what a degree of a time shorter than the predetermined time. For example, in the case where the subsequent job is started immediately after (for example less than 1 minute or the like from) the last job, typically, the secondary transfer voltage in the subsequent job is set by using Vp' of the final recording material P in the last job. Incidentally, Vp' of the final recording material P is a value substantially equal to a predetermined Vp in some instances.

In this embodiment, in the continuous image forming job, the controller 50 causes the RAM 52 to store Vp' of each of the recording materials P. Then, the controller 50 uses information of the stored Vp' for setting an initial value of the secondary transfer voltage Vtr in the subsequent job. For example, after the continuous image forming job is executed in the low humidity environment, the recording materials P into the cassette 11 are dried again in 1 hour in some instances. In this case, in the case where the subsequent job is started after a lapse of 1 hour or more from the end of the last continuous image forming job, the secondary transfer voltage in the subsequent job may be set by using Vp' of the first recording material P in the last job. Further, in the case where the subsequent job is started before the lapse of 1 hour, the secondary transfer voltage in the subsequent job may be set by using Vp' of the recording material P after the first recording material P in the last continuous image forming job. For example, in the case where the last job is a continuous image forming job of 100 sheets, if the subsequent job is started immediately after (for example, less than 1 minute from) the last job. Further, if the subsequent job is started after 30 minutes from the last job, Vp' of a 50th-recording material P may only be required to used.

Thus, in this embodiment, when the first job is a job for continuously forming images on a plurality of recording materials P, in the case where the second job is started after the lapse of the predetermined time from the end of the first job, the predetermined voltage which is the target voltage for the transfer voltage during passing of the first recording material P in the second job through the transfer portion N2 is determined by the controller 50 on the basis of the change amount of the voltage in the limiter control when the first recording material P in the first job passes through the transfer portion N2. On the other hand, in the case where the second job is started after the lapse of the predetermined time or more after the first job is ended, the predetermined voltage which is the target voltage for the transfer voltage during passing of the first recording material P in the second job through the transfer portion N2 is determined by the controller 50 on the basis of the change amount of the voltage in the limiter control when the recording material P after the first recording material P in the first job passes through the transfer portion N2.

As described above, according to this embodiment, in the job subsequent to the continuous image forming job, it is possible to perform application of the proper secondary transfer voltage from the leading end of the first recording material P, so that the occurrence of the image defect due to the excess and deficiency of the transfer current at the leading end portion of the recording material P can be suppressed.

Incidentally, in this embodiment, the low humidity environment was described as an example, but even in the high humidity environment, similar control can be carried out, so that an effect similar to the effect in the case of the low humidity environment can be achieved.

Other Embodiments

The present invention was described above based on the specific embodiments, but is not limited thereto.

In the above-described embodiments, the examples in which the offset voltage ΔVp in the last job is used as it is in the case where the condition relating to the state of the recording material, the condition relating to the adjustment or non-adjustment of the secondary transfer voltage in the operation in the adjusting mode, or the condition relating to the environment is satisfied were described. However, as described above, the present invention is not limited to such embodiments. The corrected offset voltage ΔVp may also be used when the section in which the image defect due to the excess and deficiency of the transfer current in the subsequent job can be reduced on the basis of the offset voltage ΔVp in the last job. That is, in the case where the predetermined condition is satisfied, an offset voltage (K×ΔVp) after the correction, obtained by multiplying the offset voltage ΔVp in the last job by a predetermined correction coefficient K (typically, $0<K\leq1$) is acquired. Then, by using this corrected offset voltage, a secondary transfer voltage Vtr=Vb+Vp+K×ΔVp in the subsequent job can be acquired. This predetermined correction coefficient K can be appropriately set from a viewpoint that on the basis of the offset voltage ΔVp in the last job, the image defect on the first recording material P in the subsequent job is suppressed.

That is, in the case where the predetermined voltage which is the target voltage for the transfer voltage when the first recording material P in the second job passes through the transfer portion N2 is determined on the basis of the change amount of the voltage in the limiter control in the first job, the controller 50 can set the predetermined voltage at the value obtained by adding, to the reference value corresponding to the second job, the change amount or the value obtained by multiplying the change amount by the predetermined coefficient. Typically, the coefficient is larger than 0 and 1 or less. Further, in the case where the predetermined voltage which is the target voltage for the transfer voltage when the first recording material P in the second job passes through the transfer portion N2 is not determined on the basis of the change amount of the voltage in the limiter control in the first job, the controller 50 can set the predetermined voltage at the reference value corresponding to the second job. Incidentally, the predetermined voltage when the first recording material P in the second job passes through the transfer portion N2, determined on the basis of the change amount is the initial value of the predetermined voltage when the first recording material P in the second job passes through the transfer portion N2.

Further, for example, in the case where the open/close of the feeding portion 11 is not detected by the open/close detecting portion 41 in the period from the end of the first job until the second job is started, the controller 50 is capable of determining the predetermined voltage which is the target voltage for the transfer voltage when the first recording material P in the second job passes through the transfer portion N2, on the basis of a first value obtained by multiplying the change amount of the voltage in the limiter control in the first job by a first coefficient. On the other hand, in the case where the open/close of the feeding portion 11 is detected by the open/close detecting portion 41, the controller 50 is capable of detecting the predetermined voltage when the first recording material P in the second job passes through the transfer portion N2, on the basis of a second value obtained by multiplying the change amount by the second coefficient smaller than the first coefficient. This is also true for the above-described other various conditions, i.e., in the cases of discrimination of whether or not the recording material P is supplied from the same feeding portion to the transfer portion N2 for the first job and the second job, whether or not the change in information on the recording material P is made in the period from the end of the first job until the second job is started, whether or not the absence of the recording material P in the feeding portion 11 in the period from the end of the first job until the second job is started, whether or not the change in reference setting of the predetermined voltage which is the target voltage for the transfer voltage by the adjusting portion 31 is made in the period from the end of the first job until the second job is started, whether or not the environment is the environment in the same section between the execution of the first job and during the execution of the second job, or whether or not the second job is started before a lapse of the predetermined time after the first job is ended.

Further, in the Embodiment 7, the example in which in the case where the last job is the continuous image forming job, the secondary transfer voltage in the subsequent job is detected by using the offset voltage ΔVp of the first recording material P in the last job or the recording material P (typically the final recording material P) after the first recording material P was described. However, the present invention is not limited to such an embodiment. In the case where the last job is the continuous image forming job, the occurrence of the image defect due to the excess and deficiency of the transfer current in the subsequent job may only be required to be suppressed by using the offset voltage ΔVp in the last job. The offset voltage ΔVp of any recording material P in the last job or the average of the plurality of recording materials P.

Further, the predetermined conditions, described in the above-mentioned embodiments, for discriminating whether or not the offset voltage ΔVp is succeeded can be used in arbitrary combinations.

Further, in the case where the state of the image forming apparatus enters the sleep state after the last job is ended, succession of the offset voltage ΔVp in the last job to the setting of the secondary transfer voltage in the subsequent job may also be not made. When the state of the image forming apparatus enters the sleep state, the last job information such as the offset voltage ΔVp cannot be maintained in some cases. Further, when the state of the image forming apparatus enters the sleep state, the time from the end of the last job until the second job is started cannot be detected in some cases. Further, the entrance of the image forming apparatus state into the sleep state is in general the case where the predetermined time set in advance has elapsed. For that reason, depending on the setting of the predetermined time, the state and environment of the recording material P change between the last job and the subsequent job (this job) to the degree that they are not suitable for the succession of the offset voltage ΔVp.

Further, the limiter control can also be performed by providing either one of the upper limit and the lower limit of the control. For example, in the case where the recording material larger in electric resistance than the normal recording material is used and it is known that the transfer current falls below the lower limit, only the lower limit can be provided. On the other hand, in the case where the recording material smaller in electric resistance than the normal recording material is used and it is known that the transfer current falls above the upper limit, only the upper limit can be provided. That is, the control such that the transfer current is caused to fall within the predetermined range in the limiter control includes the cases where the transfer current is made the upper limit or less, the lower limit or more, and the upper limit or less and the lower limit or more.

Further, the present invention is also similarly applicable to a monochromatic image forming apparatus including only one image forming portion. In this case, the present invention is applied to a transfer portion where the toner image is transferred from the image bearing member such as the photosensitive drum onto the recording material.

According to the present invention, it is possible to suppress that the image defect similar to the image defect occurred due to the excess and deficiency of the transfer current in the last job occurs repetitively in the subsequent job.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-122577 filed on Jun. 29, 2019, which is hereby incorporated by reference herein in its entirety.

What is claimed is:

1. An image forming apparatus comprising:

an image forming portion configured to form a toner image;

an intermediate transfer belt to which the toner image formed by the image forming portion is transferred;

an inner roller in contact with the inner surface of the intermediate transfer belt;

an outer roller forming a transfer nip for nipping a recording material and for transferring the toner image from the intermediate transfer belt to the recording material in cooperation with the inner roller;

a voltage source configured to apply a voltage to one of the inner roller and the outer roller;

a current detecting portion configured to detect information on a current flowing through the inner roller or the outer roller; and a controller configured to control the voltage source, wherein the controller is configured to perform constant voltage control so that the voltage applied from the voltage source becomes a target voltage in a case in which the detection result detected by the current detecting portion is within a predetermined range defined by at least one of an upper limit value and a lower limit value based on the type of the recording material while the recording material passes through the transfer nip, and wherein, in a case in which the detection is out of the predetermined range while the recording material passes through the transfer nip, the controller is configured (i) to adjust the target voltage so that the detection result falls within the predetermined range, and (ii) to perform constant voltage control with the adjusted target voltage while the recording material passes through the transfer nip, and wherein, in a case in which the detection result is out of the predetermined range while a first recording material in a first job passes through the transfer nip, the controller is configured (i) to adjust the target voltage while the first recording material in the first job passes through the transfer nip, and (ii) to adjust the target voltage to be applied by the voltage source, while a first recording material in a second job, which follows the first job, passes through the transfer nip, on the basis of the adjusted target voltage adjusted while the first recording material in the first job passes through the transfer nip.

2. An image forming apparatus according to claim 1, further comprising, a feeding portion provided so as to be openable and closable and configured to accommodate and feed the recording material supplied to the transfer nip, and an open/close detecting portion configured to detect opening and closing of the feeding portion, wherein in a case that each of the first recording material in the first job and the first recording material in the second job is fed from the feeding portion and the open/close of the feeding portion is detected by the open/close detecting portion in a period between the first job and the second job, the controller sets, at a preset value, the voltage applied to the transfer belt when the leading end portion of the first recording material in the second job passes through the transfer nip.

3. An image forming apparatus according to claim 1, further comprising a plurality of feeding portions each provided so as to be openable and closable, each of the plurality of feeding portions being configured to accommodate and feed the recording material supplied to the transfer nip, wherein, in a case that the feeding portion used in the first job and the feeding portion used in the second job are different from each other, even when the predetermined voltage is changed during execution of the first job the controller sets, at a preset value, the voltage applied to the transfer belt when the leading end portion of the first recording material in the second job passes through the transfer nip.

4. An image forming apparatus according to claim 1, further comprising an operating portion configured to set the voltage applied to the transfer belt by an input operation by a user, wherein, in a case that the voltage applied to the transfer belt is changed by the operating portion in a period between the first job and the second job, even when the predetermined voltage is changed during execution of the first job the controller sets, at a preset value, the voltage applied to the transfer belt when the leading end portion of the first recording material in the second job passes through the transfer nip.

5. An image forming apparatus according to claim 1, wherein, in a case that the image forming apparatus goes to a sleep state in a period between the first job and the second job, even when the predetermined voltage is changed during execution of the first job the controller sets, at a preset value, the voltage applied to the transfer belt when the leading end portion of the first recording material in the second job passes through the transfer nip.

6. An image forming apparatus according to claim 1, wherein in a case that the second job is started after a lapse of a predetermined time from an end of the first job, even when the predetermined voltage is changed during execution of the first job the controller sets, at a preset value, the voltage applied to the transfer belt when the leading end portion of the first recording material in the second job passes through the transfer nip.

7. An image forming apparatus according to claim 1, wherein the controller is configured to execute an operation for outputting a test chart for adjusting the voltage applied to the transfer belt and for adjusting the voltage applied to the transfer belt based on the test chart, and wherein, in a case that the operation is executed in a period between the first job and the second job, even when the predetermined voltage is changed during execution of the first job, the controller sets, at a preset value, the voltage applied to the transfer belt when the leading end portion of the first recording material in the second job passes through the transfer nip.

* * * * *